US010184164B2

(12) United States Patent
Doren et al.

(10) Patent No.: US 10,184,164 B2
(45) **Date of Patent: *Jan. 22, 2019**

(54) THERMO-MECHANICAL PROCESSING OF NICKEL-TITANIUM ALLOYS

(71) Applicant: ATI Properties LLC, Albany, OR (US)

(72) Inventors: Brian Van Doren, Albany, OR (US); Scott Schlegel, Albany, OR (US); Joseph Wissman, Huntsville, AL (US)

(73) Assignee: ATI PROPERTIES LLC, Albany, OR (US)

( * ) Notice: Subject to any disclaimer, the term of this patent is extended or adjusted under 35 U.S.C. 154(b) by 337 days.

This patent is subject to a terminal disclaimer.

(21) Appl. No.: 15/055,732

(22) Filed: Feb. 29, 2016

(65) Prior Publication Data

US 2016/0177431 A1 Jun. 23, 2016

Related U.S. Application Data

(63) Continuation of application No. 13/843,748, filed on Mar. 15, 2013, now Pat. No. 9,279,171.

(51) Int. Cl.

| | |
|---|---|
| ***C22F 1/10*** | (2006.01) |
| ***C22F 1/00*** | (2006.01) |
| ***C22C 14/00*** | (2006.01) |
| ***C22C 19/00*** | (2006.01) |
| ***C22F 1/18*** | (2006.01) |

(52) U.S. Cl.

CPC ..... *C22F 1/006* (2013.01); *C22C 14/00* (2013.01); *C22C 19/007* (2013.01); *C22F 1/10* (2013.01); *C22F 1/183* (2013.01)

(58) Field of Classification Search

CPC .... C22F 1/10; C22F 1/183; C22F 1/00; C22F 1/006

See application file for complete search history.

(56) References Cited

U.S. PATENT DOCUMENTS

| | | | |
|---|---|---|---|
| 4,261,412 | A | 4/1981 | Soykan et al. |
| 4,283,233 | A | 8/1981 | Goldstein et al. |
| 4,533,411 | A | 8/1985 | Melton |
| 4,631,094 | A | 12/1986 | Simpson et al. |
| 4,654,092 | A | 3/1987 | Melton |
| 4,707,196 | A | 11/1987 | Honma et al. |
| 4,769,087 | A | 9/1988 | Genereux |
| 4,770,725 | A | 9/1988 | Simpson et al. |
| 4,808,225 | A | 2/1989 | Donachie et al. |
| 4,817,858 | A | 4/1989 | Verpoort |
| 5,090,022 | A | 2/1992 | Mortimer |
| 5,283,805 | A | 2/1994 | Kawano et al. |
| 5,325,906 | A | 7/1994 | Benz et al. |
| 5,348,566 | A | 9/1994 | Sawyer et al. |
| 5,624,508 | A | 4/1997 | Flomenblit et al. |
| 5,843,244 | A | 12/1998 | Pelton et al. |
| 5,882,444 | A | 3/1999 | Flomenblit et al. |
| 5,958,159 | A | 9/1999 | Prandi |
| 6,001,195 | A | 12/1999 | Kajiwara et al. |
| 6,024,847 | A | 2/2000 | Rosenberg et al. |
| 6,149,742 | A | 11/2000 | Carpenter et al. |
| 6,428,634 | B1 | 8/2002 | Besselink et al. |
| 6,540,849 | B2 | 4/2003 | DiCarlo et al. |
| 6,719,858 | B2 | 4/2004 | Bond et al. |
| 6,772,961 | B2 | 8/2004 | Forbes Jones et al. |
| 6,946,040 | B2 | 9/2005 | Homma |
| 7,192,496 | B2 | 3/2007 | Wojcik |
| 7,374,598 | B2 | 5/2008 | Forbes Jones et al. |
| 7,578,960 | B2 | 8/2009 | Forbes Jones et al. |
| 7,628,874 | B2 | 12/2009 | Wojcik |
| 8,440,031 | B2 | 5/2013 | Syed et al. |
| 8,475,711 | B2 | 7/2013 | Wojcik |
| 8,916,091 | B2 | 12/2014 | Koehl et al. |
| 9,279,171 | B2 | 3/2016 | Van Doren et al. |
| 2002/0098105 | A1 | 7/2002 | Kadavy et al. |
| 2002/0185200 | A1 | 12/2002 | DiCarlo et al. |
| 2004/0177904 | A1 | 9/2004 | Kajiwara et al. |
| 2008/0179034 | A1 | 7/2008 | Forbes Jones et al. |
| 2013/0266817 | A1 | 10/2013 | Wojcik |

FOREIGN PATENT DOCUMENTS

| | | | |
|---|---|---|---|
| CN | 1170834 | A | 1/1998 |
| CN | 1752246 | A | 3/2006 |
| CN | 1752248 | A | 3/2006 |
| JP | S62-188735 | A | 8/1987 |
| JP | 2002-69555 | A | 3/2002 |
| JP | 2009-13461 | A | 1/2009 |
| RU | 2162900 | C1 | 2/2001 |
| SU | 1759946 | A1 | 9/1992 |
| SU | 1431353 | A1 | 6/1995 |
| WO | WO 98/49363 | A1 | 11/1998 |

(Continued)

OTHER PUBLICATIONS

Chengchang et al., "Composites Course", Higher Education Press; Nov. 2010, p. 334.

ASM Materials Engineering Dictionary, J.R. Davis & Associates, eds., ASM International, United States of America, (1992), pp. 339, 432.

ASTM E1941-04 (2004): Standard Test Method for Determination of Carbon in Refractory and Reactive Metals and Their Alloys.

ASTM F2005-05, Standard Terminology for Nickel-Titanium Shape Memory Alloys, ASTM International, West Conshohocken, Pennsylvania, Oct. 2005, 3 pages.

ASTM F 2063-05, Standard Specification for Wrought Nickel-Titanium Shape Memory Alloys for Medical Devices and Surgical Implants, ASTM International, West Conshohocken, Pennsylvania, Nov. 2005, 4 pages.

ASTM F2082-06, Standard Test Method for Determination of Transformation Temperature of Nickel-Titanium Shape Memory Alloys by Bend and Free Recovery, ASTM International, West Conshohocken, Pennsylvania, Aug. 2006, 7 pages.

(Continued)

*Primary Examiner* — Jessee R Roe

(74) *Attorney, Agent, or Firm* — K&L Gates LLP; Robert J. Toth

(57) ABSTRACT

Processes for the production of nickel-titanium mill products are disclosed. A nickel-titanium alloy workpiece is cold worked at a temperature less than 500° C. The cold worked nickel-titanium alloy workpiece is hot isostatic pressed (HIP'ed).

27 Claims, 20 Drawing Sheets

(56) References Cited

FOREIGN PATENT DOCUMENTS

| | | |
|---|---|---|
| WO | WO 01/12359 A1 | 2/2001 |
| WO | WO 02/058866 A2 | 8/2002 |

OTHER PUBLICATIONS

ASTM E1097-07 (2007): Standard Guide for Direct Current Plasma-Atomic Emission Spectrometry Analysis.
ASTM E1508-98 (2008): Standard Guide for Quantitative Analysis by Energy-Dispersive Spectroscopy.
ASTM E1409-08 (2008): Standard Test Method for Determination of Oxygen and Nitrogen in Titanium and Titanium Alloys by the Inert Gas Fusion Technique.
ASTM E1447-09 (2009): Standard Test Method for Determination of Hydrogen in Titanium and Titanium Alloys by the Inert Gas Fusion Thermal Conductivity/Infrared Detection Method.
ASTM E1245-03, Standard Practice for Determining the Inclusion or Second-Phase Constituent Content of Metals by Automatic Image Analysis, ASTM International, West Conshohocken, Pennsylvania, Jan. 2009, 8 pages.
ASTM B822-10 (2010): Standard Test Method for Particle Size Distribution of Metal Powders and Related Compounds by Light Scattering.
ASTM F2004-05, Standard Test Method for Transformation Temperature of Nickel-Titanium Alloys by Thermal Analysis, ASTM International, West Conshohocken, Pennsylvania, Sep. 2010, 4 pages.
ASTM E112-10, Standard Test Methods for Determining Average Grain Size, ASTM International, West Conshohocken, Pennsylvania, Dec. 2010, 26 pages.
Coda et al., "Effect of Melting Process Parameters on Martensitic NiTi Ingots Properties," Proceeding of International Conference on Shape Memory and Superelastic Technologies, May 2006, pp. 439-445.
Drexel et al., "The Effects of Cold Work and Heat Treatment on the Properties of Nitinol Wire," Proceeding of International Conference on Shape Memory and Superelastic Technologies, May 2006, pp. 447-454.
Duerig, T.W., "Ni•Ti Alloys by Powder Metallurgical Methods," Proceeding of First International Conference on Shape Memory and Superelastic Technologies, 1994, pp. 31-36.
Duerig et al. "Ti—Ni Shape Memory Alloys," Material Properties Handbook: Titanium Alloys, ASM: 1994, pp. 1035-1048.
Gall et al., "The Role of Coherent Precipitates in Martensitic Transformations in Single Crystal and Polycrystalline Ti-50.8at% Ni," Scripta Materialia, vol. 39, No. 6 (1998), pp. 699-705.
Graham et al., "Characteristics of high purity nitinol," Proceeding of the International Conference on Shape Memory and Superelastic Technologies, ASM: 2003, pp. 7-14.
Horikawa et al., "Reversible Characteristic Changes in Yield Stresses of a NiTi Alloy," Proceedings of the MRS International Meeting of Advanced Materials, vol. 9, Shape Memory Alloys, 1989, pp. 195-200, Materials Research Society, Pittsburgh, PA.
Liu et al., "Asymmetry of Stress-Strain Curves Under Tension and Compression for NiTi Shape Memory Alloys," Acta Meterailia, vol. 46, No. 12 (1998), pp. 4325-4338.
Matsumoto et al., "Crystallography of Martensitic Transformation in Ti—Ni Single Crystals," Acta Metallurgica, vol. 35, No. 8 (1987), pp. 2137-2144.
Miyazaki et al., "The Habit Plane and Transformation Strains Associated with the Martensitic Transformation in Ti—Ni Single Crystals," Scripta Metallurgica, vol. 18 (1984), pp. 883-888.
Morgan et al., "Carbon and oxygen levels in nitinol alloys and the implications for medical device manufacture and durability," Proceeding of the International Conference on Shape Memory and Superelastic Technologies, ASM: 2008, pp. 821-828.
Nishida et al., "Precipitation Processes in Near-Equiatomic TiNi Shape Memory Alloys," Metallurgical Transactions A, vol. 17A, Sep. 1986, pp. 1505-1515.
Otsuka and Kakeshita, "Science and Technology of Shape-Memory Alloys: New Developments," MRS Bulletin, Feb. 2002, pp. 91-100.
Otsuka et al., "Physical metallurgy of Ti—Ni-based shape memory alloys," Progress in Materials Science, 50, 2005, pp. 511-678.
Patel et al, "The Significance of Melt Practice on Fatigue Properties of Superelastic NiTi Fine Diameter Wire," Proceeding of International Conference on Shape Memory and Superelastic Technologies, May 2006, 6 pages.
Pelton et al, "The physical metallurgy of nitinol for medical applications," JOM, 2003, pp. 33-37.
Russell, Scott M., "Nitinol Melting and Fabrication", SMST-2000 Conference Proceedings, International Organization of Shape Memory and Superelastic Technology, Jan. 1, 2000, pp. 1-9.
Schuller et al., "Hot Isostatic Pressing (HIP) of Elemental Powder Mixtures and Prealloyed Powder for NiTi Shape Memory Parts", Advanced Engineering Materials, Wiley VCH Verlag, Weinheim, DE, vol. 5, No. 12, Jan. 1, 2003, pp. 918-924.
Sehitoglu et al., "Compressive Response of NiTi Single Crystals," Acta Materialia, vol. 48, No. 13 (2000), pp. 3311-3326.
Stoeckel, "Forming Nitinol—A Challenge," New Developments in Forging Technology, K. Siegert, ed., 2001, pp. 119-134.
Stoeckel et al., "Self-expanding nitinol stents—material and design considerations," European Radiology, 2003, pp. 1-12.
Tadaki et al., "Crystal Structure, Composition and Morphology of a Precipitate in an Aged Ti-51at%Ni Shape Memory Alloy," Transactions of the Japan Institute of Metals, vol. 27, No. 10 (1986), pp. 731-740.
Toro et al., "Characterization of non-metallic inclusions in superelastic NiTi tubes," J. Materials Engineering and Performance, 18(5-6), 2009, pp. 448-458.
Uchil et al., "Study of Critical Dependence of Stable Phases in Nitinol on Heat Treatment Using Electrical Resistivity Probe," Materials Science and Engineering A, vol. 251, Nos. 1-2 (1998), pp. 58-63.
Vamsi et al., "Laser Processing of Net-Shape NiTi Shape Memory Alloy", Metallurgical and Materials Transactions, Springer-Verlag, New York, vol. 38, No. 5, Apr. 21, 2007, pp. 1096-1103.
Venugopalan et al., "Corrosion of Nitinol," Proceeding of International Conference on Shape Memory and Superelastic Technologies, 2000, pp. 261-270.
Wasilewski et al., "Homogenity Range and the Martensitic Transformation in TiNi," Metallurgical Transactions, vol. 2, Jan. 1971, pp. 229-238.
Wasilewski, "The Effects of Applied Stress on the Martensitic Transformation in TiNi," Metallurgical Transactions, vol. 2, Nov. 1971, pp. 2973-2981.
Zhu et al., "Oxidation of Nitinol," Proceeding of International Conference on Shape Memory and Superelastic Technologies, 2003, pp. 357-368.
ASTM F 2063-12, Standard Specification for Wrought Nickel-Titanium Shape Memory Alloys for Medical Devices and Surgical Implants, ASTM International, West Conshohocken, Pennsylvania, Jan. 2013, 6 pages.
Chunshui et al., "Design and Manufacturing of High-Efficiency and Precision Punch Die", Xidian University Press, 1st edition, Jun. 1989, p. 22.

THERMO-MECHANICAL PROCESSING OF NICKEL-TITANIUM ALLOYS

CROSS-REFERENCE TO RELATED APPLICATIONS

This patent application is a continuation application and claims the benefit of the filing date under 35 U.S.C. § 120 of co-pending U.S. patent application Ser. No. 13/843,748, filed on Mar. 15, 2013. U.S. patent application Ser. No. 13/843,748 is incorporated by reference into this specification.

TECHNICAL FIELD

This specification is directed to processes for producing nickel-titanium alloy mill products and to the mill products produced by the processes described in this specification.

BACKGROUND

Equiatomic and near-equiatomic nickel-titanium alloys possess both "shape memory" and "superelastic" properties. More specifically, these alloys, which are commonly referred to as "Nitinol" alloys, are known to undergo a martensitic transformation from a parent phase (commonly referred to as the austenite phase) to at least one martensite phase on cooling to a temperature below the martensite start temperature ("$M_s$") of the alloy. This transformation is complete on cooling to the martensite finish temperature ("$M_f$") of the alloy. Further, the transformation is reversible when the material is heated to a temperature above its austenite finish temperature ("$A_f$").

This reversible martensitic transformation gives rise to the shape memory properties of the alloys. For example, a nickel-titanium shape-memory alloy can be formed into a first shape while in the austenite phase (i.e., at a temperature above the $A_f$ of the alloy), subsequently cooled to a temperature below the $M_f$, and deformed into a second shape. As long as the material remains below the austenite start temperature ("$A_s$") of the alloy (i.e., the temperature at which the transition to austenite begins), the alloy will retain the second shape. However, if the shape-memory alloy is heated to a temperature above the $A_f$, the alloy will revert back to the first shape if not physically constrained, or when constrained can exert a stress upon another article. Recoverable strains of up to 8% are generally achievable with nickel-titanium alloys due to the reversible austenite-to-martensite thermally-induced transition, and hence the term "shape-memory."

The transformation between the austenite and martensite phases also gives rise to the "pseudoelastic" or "superelastic" properties of shape-memory nickel-titanium alloys. When a shape-memory nickel-titanium alloy is strained at a temperature above the $A_f$ of the alloy but below the so-called martensite deformation temperature ("$M_d$"), the alloy can undergo a stress-induced transformation from the austenite phase to the martensite phase. The $M_d$ is therefore defined as the temperature above which martensite cannot be stress-induced. When a stress is applied to a nickel-titanium alloy at a temperature between $A_f$ and $M_d$, after a small elastic deformation, the alloy yields to the applied stress through a transformation from austenite to martensite. This transformation, combined with the ability of the martensite phase to deform under the applied stress by movement of twinned boundaries without the generation of dislocations, permits a nickel-titanium alloy to absorb a large amount of strain energy by elastic deformation without plastically (i.e., permanently) deforming. When the strain is removed, the alloy is able to revert back to its unstrained condition, and hence the term "pseudoelastic." Recoverable strains of up to 8% are generally achievable with nickel-titanium alloys due to the reversible austenite-to-martensite stress-induced transition, and hence the term "superelastic." Thus, superelastic nickel-titanium alloys macroscopically appear to be very elastic relative to other alloys. The terms "pseudoelastic" and "superelastic" are synonymous when used in connection with nickel-titanium alloys, and the term "superelastic" is used in this specification.

The ability to make commercial use of the unique properties of shape-memory and superelastic nickel-titanium alloys is dependent in part upon the temperatures at which these transformations occur, i.e., the $A_s$, $A_f$, $M_s$, $M_f$, and $M_d$ of the alloy. For example, in applications such as vascular stents, vascular filters, and other medical devices, it is generally important that nickel-titanium alloys exhibit superelastic properties within the range of in vivo temperatures, i.e., $A_f \leq -37°$ C.$\leq M_d$. It has been observed that the transformation temperatures of nickel-titanium alloys are highly dependent on composition. For example, it has been observed that the transformation temperatures of nickel-titanium alloys can change more than 100 K for a 1 atomic percent change in composition of the alloys.

In addition, various applications of nickel-titanium alloys, such as, for example, actuators and implantable stents and other medical devices, may be considered to be fatigue critical. Fatigue refers to the progressive and localized structural damage that occurs when a material is subjected to cyclic loading. The repetitive loading and unloading causes the formation of microscopic cracks that may increase in size as a material is further subjected to cyclic loading at stress levels well below the material's yield strength, or elastic limit. Fatigue cracks may eventually reach a critical size, resulting in the sudden failure of a material subjected to cyclic loading. It has been observed that fatigue cracks tend to initiate at non-metallic inclusions and other second phases in nickel-titanium alloys. Accordingly, various applications of nickel-titanium alloys, such as, for example, actuators, implantable stents, and other fatigue critical devices, may be considered to be inclusion and second phase critical.

SUMMARY

In a non-limiting embodiment, a process for the production of a nickel-titanium alloy mill product comprises cold working a nickel-titanium alloy workpiece at a temperature less than 500° C., and hot isostatic pressing (HIP'ing) the cold worked nickel-titanium alloy workpiece.

In another non-limiting embodiment, a process for the production of a nickel-titanium alloy mill product comprises hot working a nickel-titanium alloy workpiece at a temperature greater than or equal to 500° C. and then cold working the hot worked nickel-titanium alloy workpiece at a temperature less than 500° C. The cold worked nickel-titanium alloy workpiece is hot isostatic pressed (HIP'ed) for at least 0.25 hour in a HIP furnace operating at a temperature in the range of 700° C. to 1000° C. and a pressure in the range of 3,000 psi to 25,000 psi.

In another non-limiting embodiment, a process for the production of a nickel-titanium alloy mill product comprises hot forging a nickel-titanium alloy ingot at a temperature greater than or equal to 500° C. to produce a nickel-titanium alloy billet. The nickel-titanium alloy billet is hot bar rolled at a temperature greater than or equal to 500° C. to produce a nickel-titanium alloy workpiece. The nickel-titanium alloy workpiece is cold drawn at a temperature less than 500° C. to produce a nickel-titanium alloy bar. The cold worked nickel-titanium alloy bar is hot isostatic pressed for at least 0.25 hour in a HIP furnace operating at a temperature in the range of 700° C. to 1000° C. and a pressure in the range of 3,000 psi to 25,000 psi.

It is understood that the invention disclosed and described in this specification is not limited to the embodiments summarized in this Summary.

BRIEF DESCRIPTION OF THE DRAWINGS

Various features and characteristics of the non-limiting and non-exhaustive embodiments disclosed and described in this specification may be better understood by reference to the accompanying figures, in which.

Figure 1:
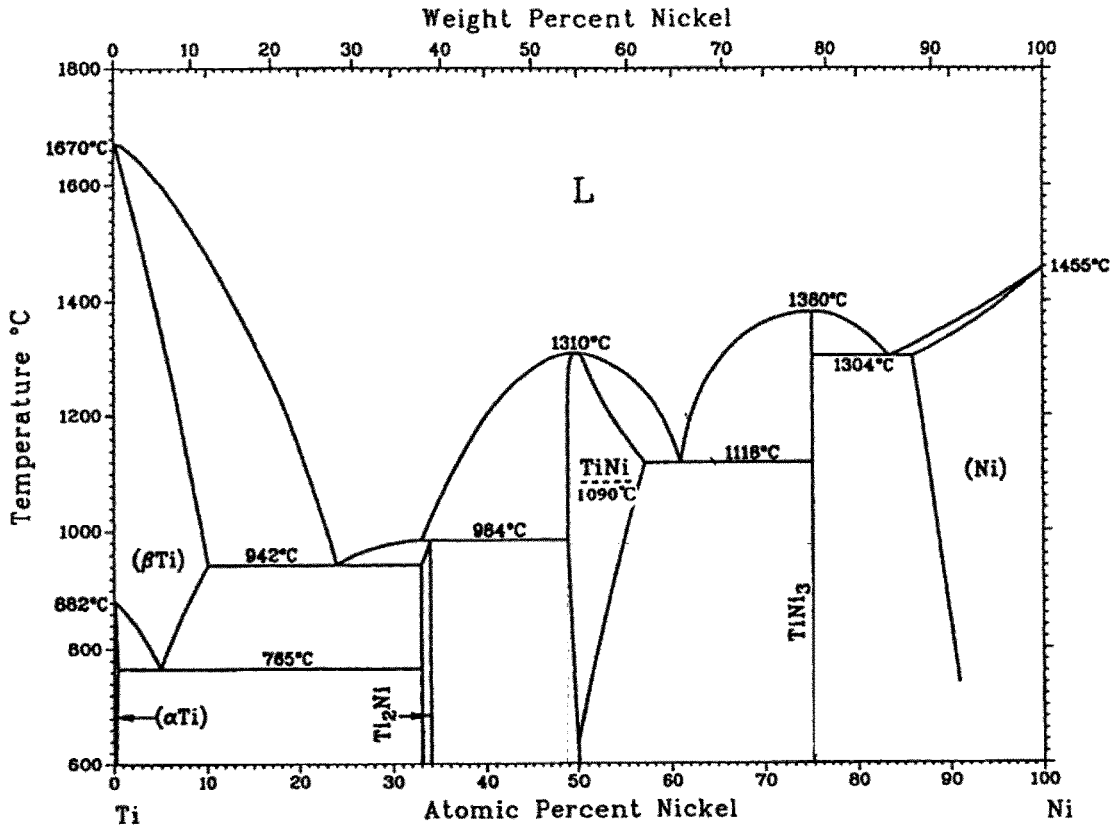
FIG. 1 is an equilibrium phase diagram for binary nickel-titanium alloys.

The reader will appreciate the foregoing details, as well as others, upon considering the following detailed description of various non-limiting and non-exhaustive embodiments according to this specification.

DESCRIPTION

Various embodiments are described and illustrated in this specification to provide an overall understanding of the function, operation, and implementation of the disclosed processes for the production of nickel-titanium alloy mill products. It is understood that the various embodiments described and illustrated in this specification are non-limiting and non-exhaustive. Thus, the invention is not necessarily limited by the description of the various non-limiting and non-exhaustive embodiments disclosed in this specification. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, the Applicant(s) reserve the right to amend the claims to affirmatively disclaim features or characteristics that may be present in the prior art. Therefore, any such amendments comply with the requirements of 35 U.S.C. §§ 112(a) and 132(a). The various embodiments disclosed and described in this specification can comprise, consist of, or consist essentially of the features and characteristics as variously described in this specification.

Also, any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited in this specification is intended to include all lower numerical limitations subsumed therein and any minimum numerical limitation recited in this specification is intended to include all higher numerical limitations subsumed therein. Accordingly, the Applicant(s) reserve the right to amend this specification, including the claims, to expressly recite any sub-range subsumed within the ranges expressly recited herein. All such ranges are intended to be inherently described in this specification such that amending to expressly recite any such sub-ranges would comply with the requirements of 35 U.S.C. §§ 112(a) and 132(a).

Any patent, publication, or other disclosure material identified herein is incorporated by reference into this specification in its entirety unless otherwise indicated, but only to the extent that the incorporated material does not conflict with existing descriptions, definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

Various embodiments described in this specification are directed to processes for producing a nickel-titanium alloy mill product having improved microstructure such as, for example, reduced area fraction and size of non-metallic inclusions and porosity. As used herein, the term "mill product" refers to alloy articles produced by thermo-mechanical processing of alloy ingots. Mill products include, but are not limited to, billets, bars, rods, wire, tubes, slabs, plates, sheets, and foils. Also, as used herein, the term "nickel-titanium alloy" refers to alloy compositions comprising at least 35% titanium and at least 45% nickel based on the total weight of the alloy composition. In various embodiments, the processes described in this specification are applicable to near-equiatomic nickel-titanium alloys. As used herein, the term "near-equiatomic nickel-titanium alloy" refers to alloys comprising 45.0 atomic percent to 55.0 atomic percent nickel, balance titanium and residual impurities. Near-equiatomic nickel-titanium alloys include equiatomic binary nickel-titanium alloys consisting essentially of 50% nickel and 50% titanium, on an atomic basis.

Nickel-titanium alloy mill products may be made from processes that comprise, for example: formulating the alloy chemistry using a melting technique such as vacuum induction melting (VIM) and/or vacuum arc remelting (VAR); casting a nickel-titanium alloy ingot; forging the cast ingot into a billet; hot working the billet to a mill stock form; cold working (with optional intermediate anneals) the mill stock form to a mill product form; and mill annealing the mill product form to produce a final mill product. These processes may produce mill products that have variable microstructural characteristics such as microcleanliness. As used herein, the term "microcleanliness" refers to the non-metallic inclusion and porosity characteristics of a nickel-titanium alloy as defined in section 9.2 of ASTM F 2063-12*: Standard Specification for Wrought Nickel-Titanium Shape Memory Alloys for Medical Devices and Surgical Implants*, which is incorporated by reference into this specification. For producers of nickel-titanium alloy mill products, it may be commercially important to produce nickel-titanium alloy mill products that consistently meet the microcleanliness and other requirements of industry standards such as the ASTM F 2063-12 specification.

The processes described in this specification comprise cold working a nickel-titanium alloy workpiece at a temperature less than 500° C., and hot isostatic pressing the cold worked nickel-titanium alloy workpiece. The cold working reduces the size and the area fraction of non-metallic inclusions in the nickel-titanium alloy workpiece. The hot isostatic pressing reduces or eliminates the porosity in the nickel-titanium alloy workpiece.

In general, the term "cold working" refers to working an alloy at a temperature below that at which the flow stress of the material is significantly diminished. As used herein in connection with the disclosed processes, "cold working," "cold worked," "cold forming," "cold rolling," and like terms (or "cold" used in connection with a particular working or forming technique, e.g., "cold drawing") refer to working or the state of having been worked, as the case may be, at a temperature less than 500° C. Cold working operations may be performed when the internal and/or the surface temperature of a workpiece is less than 500° C. Cold working operations may be performed at any temperature less than 500° C., such as, for example, less than 400° C., less than 300° C., less than 200° C., or less than 100° C. In various embodiments, cold working operations may be performed at ambient temperature. In a given cold working operation, the internal and/or surface temperature of a nickel-titanium alloy workpiece may increase above a specified limit (e.g., 500° C. or 100° C.) during the working due to adiabatic heating; however, for purposes of the processes described in this specification, the operation is still a cold working operation.

In general, hot isostatic pressing (HIP or HIP'ing) refers to the isostatic (i.e., uniform) application of a high pressure and high temperature gas, such as, for example, argon, to the external surfaces of a workpiece in a HIP furnace. As used herein in connection with the disclosed processes, "hot isostatic pressing," "hot isostatic pressed," and like terms or acronyms refer to the isostatic application of a high pressure and high temperature gas to a nickel-titanium alloy workpiece in a cold worked condition. In various embodiments, a nickel-titanium alloy workpiece may be hot isostatic pressed in a HIP furnace operating at a temperature in the range of 700° C. to 1000° C. and a pressure in the range of 3,000 psi to 50,000 psi. In some embodiments, a nickel-titanium alloy workpiece may be hot isostatic pressed in a HIP furnace operating at a temperature in the range of 750° C. to 950° C., 800° C. to 950° C., 800° C. to 900° C., or 850° C. to 900° C.; and at a pressure in the range of 7,500 psi to 50,000 psi, 10,000 psi to 45,000 psi, 10,000 psi to 25,000 psi, 10,000 psi to 20,000 psi, 10,000 psi to 17,000 psi, 12,000 psi to 17,000 psi, or 12,000 psi to 15,000 psi. In various embodiments, a nickel-titanium alloy workpiece may be hot isostatic pressed in a HIP furnace for at least 0.25 hour, and in some embodiments, for at least 0.5 hour, 0.75 hour. 1.0 hour, 1.5 hours, or at least 2.0 hours, at temperature and pressure.

As used herein, the term "non-metallic inclusions" refers to secondary phases in a NiTi metallic matrix comprising non-metal constituents such as carbon and/or oxygen atoms. Non-metallic inclusions include both $Ti_4Ni_2O$), oxide non-metallic inclusions and titanium carbide (TiC) and/or titanium oxy-carbide (Ti(C,O)) non-metallic inclusions. Non-metallic inclusions do not include discrete inter-metallic phases, such as, $Ni_4Ti_3$, $Ni_3Ti_2$, $Ni_3Ti$, and $Ti_2Ni$, which may also form in near-equiatomic nickel-titanium alloys.

An equiatomic nickel-titanium alloy consisting essentially of 50% nickel and 50% titanium, on an atomic basis (approximately 55% Ni, 45% Ti, by weight), has an austenite phase consisting essentially of a NiTi B2 cubic structure (i.e., a cesium chloride type structure). The martensitic transformations associated with the shape-memory effect and superelasticity are diffusionless, and the martensite phase has a B19' monoclinic crystal structure. The NiTi phase field is very narrow and essentially corresponds to equiatomic nickel-titanium at temperatures below about 650° C. See FIG. 1. The boundary of the NiTi phase field on the Ti-rich side is essentially vertical from ambient temperature up to about 600° C. The boundary of the NiTi phase field on the Ni-rich side decreases with decreasing temperature, and the solubility of nickel in B2 NiTi is negligible at about 600° C. and below. Therefore, near-equiatomic nickel-titanium alloys generally contain inter-metallic second phases (e.g., $Ni_4Ti_3$, $Ni_3Ti_2$, $Ni_3Ti$, and $Ti_2Ni$), the chemical identity of which depends upon whether a near-equiatomic nickel-titanium alloy is Ti-rich or Ni-rich.

As previously described, nickel-titanium alloy ingots may be cast from molten alloy melted using vacuum induction melting (VIM). A titanium input material and a nickel input material may be placed in a graphite crucible in a VIM furnace and melted to produce the molten nickel-titanium alloy. During melting, carbon from the graphite crucible may dissolve into the molten alloy. During casting of a nickel-titanium alloy ingot, the carbon may react with the molten alloy to produce cubic titanium carbide (TiC) and/or cubic titanium oxy-carbide (Ti(C,O)) particles that form non-metallic inclusions in the cast ingot. VIM ingots may generally contain 100-800 ppm carbon by weight and 100-

400 ppm oxygen by weight, which may produce relatively large non-metallic inclusions in the nickel-titanium alloy matrix.

Nickel-titanium alloy ingots may also be produced from molten alloy melted using vacuum arc remelting (VAR). In this regard, the term VAR may be a misnomer because the titanium input material and the nickel input material may be melted together to form the alloy composition in the first instance in a VAR furnace, in which case the operation may be more accurately termed vacuum arc melting. For consistency, the terms "vacuum arc remelting" and "VAR" are used in this specification to refer to both alloy remelting and initial alloy melting from elemental input materials or other feed materials, as the case may be in a given operation.

A titanium input material and a nickel input material may be used to mechanically form an electrode that is vacuum arc remelted into a water-cooled copper crucible in a VAR furnace. The use of a water-cooled copper crucible may significantly reduce the level of carbon pickup relative to nickel-titanium alloy melted using VIM, which requires a graphite crucible. VAR ingots may generally contain less than 100 ppm carbon by weight, which significantly reduces or eliminates the formation of titanium carbide (TiC) and/or titanium oxy-carbide (Ti(C,O)) non-metallic inclusions. However, VAR ingots may generally contain 100-400 ppm oxygen by weight when produced from titanium sponge input material, for example. The oxygen may react with the molten alloy to produce $Ti_4Ni_2O_x$ oxide non-metallic inclusions, which have nearly the same cubic structure (space group Fd3m) as a $Ti_2Ni$ intermetallic second phase generally present in Ti-rich near-equiatomic nickel-titanium alloys, for example. These non-metallic oxide inclusions have even been observed in high purity VAR ingots melted from low-oxygen (<60 ppm by weight) iodide-reduced titanium crystal bar.

Cast nickel-titanium alloy ingots and articles formed from the ingots may contain relatively large non-metallic inclusions in the nickel-titanium alloy matrix. These large non-metallic inclusion particles may adversely affect the fatigue life and surface quality of nickel-titanium alloy articles, particularly near-equiatomic nickel-titanium alloy articles. In fact, industry-standard specifications place strict limits on the size and area fraction of non-metallic inclusions in nickel-titanium alloys intended for use in fatigue-critical and surface quality-critical applications such as, for example, actuators, implantable stents, and other medical devices. See ASTM F 2063-12: *Standard Specification for Wrought Nickel-Titanium Shape Memory Alloys for Medical Devices and Surgical Implants*, which is incorporated by reference into this specification. Therefore, it may be important to minimize the size and area fraction of non-metallic inclusions in nickel-titanium alloy mill products.

Figure 2B:
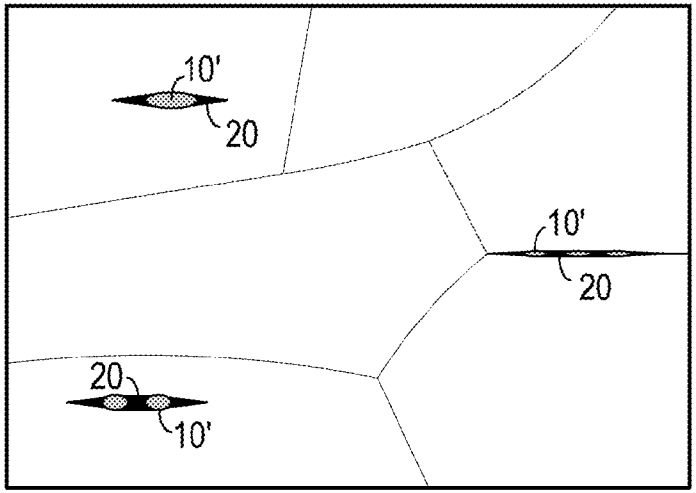
FIGS. 2A and 2B are schematic diagrams illustrating the effect of working on non-metallic inclusions and porosity in nickel-titanium alloy microstructure.
Figure 2A:
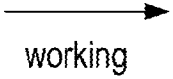
Figure 2A:
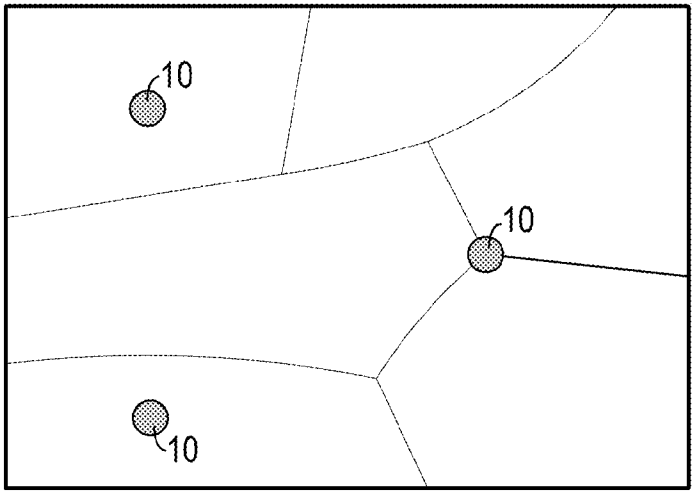
Figure 3:
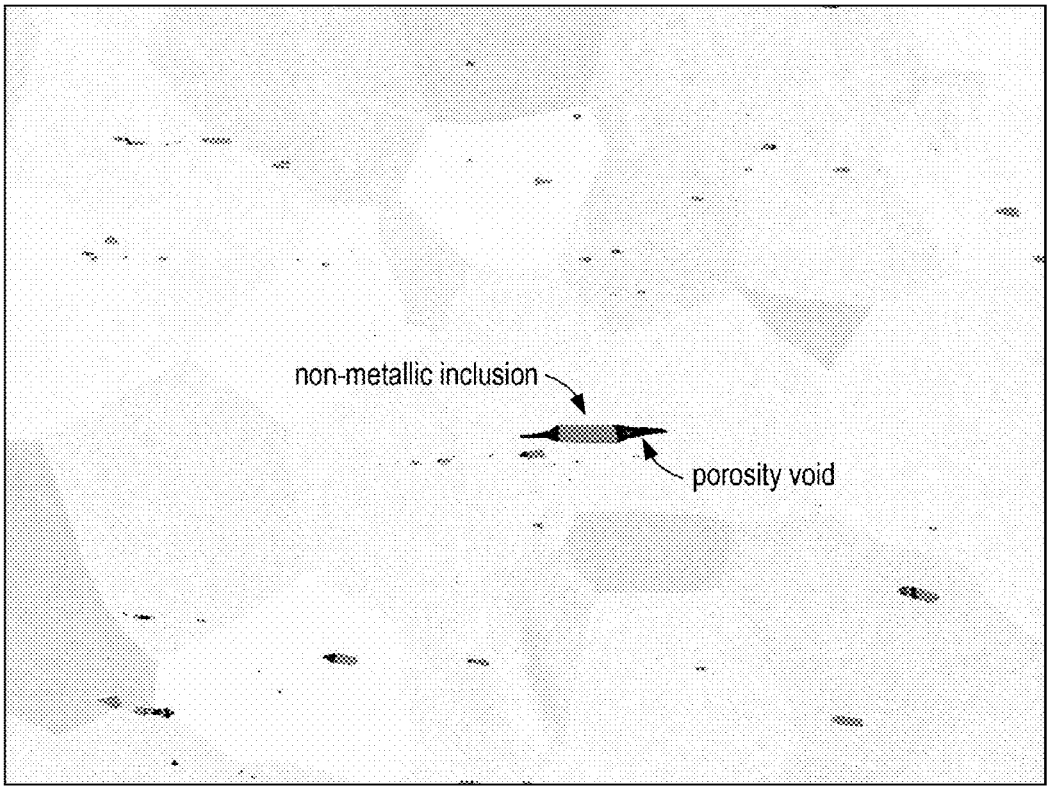
FIG. 3 is a scanning electron microscopy (SEM) image (500× magnification in backscatter electron mode) showing non-metallic inclusions and associated porosity in a nickel-titanium alloy.

The non-metallic inclusions that form in cast nickel-titanium alloys are generally friable and break-up and move during working of the material. The break-up, elongation, and movement of the non-metallic inclusions during working operations decreases the size of non-metallic inclusions in nickel-titanium alloys. However, the break-up and movement of the non-metallic inclusions during working operations may also simultaneously cause the formation of microscopic voids that increase the porosity in the bulk material. This phenomenon is shown in FIGS. 2A and 2B, which schematically illustrate the counter-effects of working on non-metallic inclusions and porosity in nickel-titanium alloy microstructure. FIG. 2A illustrates the microstructure of a nickel-titanium alloy comprising non-metallic inclusions 10 but lacking porosity. FIG. 2B illustrates the effect of working on the non-metallic inclusions 10', which are shown broken-up into smaller particles and separated, but with increased porosity 20 interconnecting the smaller inclusion particles. FIG. 3 is an actual scanning electron microscopy (SEM) image (500× in backscatter electron mode) showing a non-metallic inclusion and associated porosity voids in a nickel-titanium alloy.

Like non-metallic inclusions, porosity in nickel-titanium alloys can adversely affect the fatigue life and surface quality of nickel-titanium alloy products. In fact, industry-standard specifications also place strict limits on the porosity in nickel-titanium alloys intended for use in fatigue-critical and surface quality-critical applications such as, for example, actuators, implantable stents, and other medical devices. See ASTM F 2063-12*: Standard Specification for Wrought Nickel-Titanium Shape Memory Alloys for Medical Devices and Surgical Implants.*

Specifically, in accordance with the ASTM F 2063-12 specification, for near-equiatomic nickel-titanium alloys having an $A_s$ less than or equal to 30° C., the maximum allowable length dimension of porosity and non-metallic inclusions is 39.0 micrometers (0.0015 inch), wherein the length includes contiguous particles and voids, and particles separated by voids. Additionally, porosity and non-metallic inclusions cannot constitute more than 2.8% (area percent) of a nickel-titanium alloy microstructure as viewed at 400× to 500× magnification in any field of view. These measurements may be made in accordance with ASTM E1245-03 (2008)—*Standard Practice for Determining the Inclusion or Second-Phase Constituent Content of Metals by Automatic Image Analysis*, which is incorporated by reference into this specification, or an equivalent method.

Referring to FIGS. 2A and 2B, while working a nickel-titanium alloy may decrease the size of non-metallic inclusions, the net result may be to increase the total size and area fraction of non-metallic inclusions combined with porosity. Therefore, the consistent and efficient production of nickel-titanium alloy material that meets the strict limits of industry standards, such as the ASTM F 2063-12 specification, has proven to be a challenge to the producers of nickel-titanium alloy mill products. The processes described in this specification meet that challenge by providing nickel-titanium alloy mill products having improved microstructure, including reduced size and area fraction of both non-metallic inclusions and porosity. For example, in various embodiments, the nickel-titanium alloy mill products produced by the processes described in this specification meet the size and area fraction requirements of the ASTM F 2063-12 standard specification, only measured after cold working.

As previously described, a process for the production of a nickel-titanium alloy mill product may comprise cold working and hot isostatic pressing a nickel-titanium alloy workpiece. The cold working of a nickel-titanium alloy workpiece at a temperature less than 500° C., such as at ambient temperature, for example, effectively breaks-up and moves non-metallic inclusions along the direction of the applied cold work and reduces the size of the non-metallic inclusions in the nickel-titanium alloy workpiece. The cold working may be applied to a nickel-titanium alloy workpiece after any final hot working operations have been completed. In general, "hot working" refers to working an alloy at a temperature above that at which the flow stress of the material is significantly diminished. As used herein in connection with the described processes, "hot working," "hot worked," "hot forging," "hot rolling," and like terms (or "hot" used in connection with a particular working or forming technique) refer to working, or the state of having been worked, as the case may be, at a temperature greater than or equal to 500° C.

In various embodiments, a process for the production of a nickel-titanium alloy mill product may comprise a hot working operation before the cold working operation. As described above, nickel-titanium alloys may be cast from nickel and titanium input materials using VIM and/or VAR to produce nickel-titanium alloy ingots. The cast nickel-titanium alloy ingots may be hot worked to produce a billet. For example, in various embodiments, a cast nickel-titanium alloy ingot (workpiece) having a diameter in the range of 10.0 inches to 30.0 inches may be hot worked (e.g., by hot rotary forging) to produce a billet having a diameter in the range of 2.5 inches to 8.0 inches. Nickel-titanium alloy billets (workpieces) may be hot bar rolled, for example, to produce rod or bar stock having a diameter in the range of 0.218 inches to 3.7 inches. Nickel-titanium alloy rod or bar stock (workpieces) may be hot drawn, for example, to produce nickel-titanium alloy rods, bars, or wire having a diameter in the range of 0.001 inches to 0.218 inches. Following any hot working operations, a nickel-titanium alloy mill product (in an intermediate form) may be cold worked in accordance with embodiments described in this specification to produce the final macrostructural form of a nickel-titanium alloy mill product. As used herein, the terms "macrostructure" or "macrostructural" refer to the macroscopic shape and dimensions of an alloy workpiece or mill product, in contrast to "microstructure," which refers to the microscopic grain structure and phase structure of an alloy material (including inclusions and porosity).

In various embodiments, cast nickel-titanium alloy ingots may be hot worked using forming techniques including, but not limited to, forging, upsetting, drawing, rolling, extruding, pilgering, rocking, swaging, heading, coining, and combinations of any thereof. One or more hot working operations may be used to convert a cast nickel-titanium alloy ingot into a semi-finished or intermediate mill product (workpiece). The intermediate mill product (workpiece) may be subsequently cold worked into a final macrostructural form for the mill product using one or more cold working operations. The cold working may comprise forming techniques including, but not limited to, forging, upsetting, drawing, rolling, extruding, pilgering, rocking, swaging, heading, coining, and combinations of any thereof. In various embodiments, a nickel-titanium alloy workpiece (e.g., an ingot, a billet, or other mill product stock form) may be hot worked using at least one hot working technique and subsequently cold worked using at least one cold working technique. In various embodiments, hot working may be performed on a nickel-titanium alloy workpiece at an initial internal or surface temperature in the range of 500° C. to 1000° C., or any sub-range subsumed therein, such as, for example, 600° C. to 900° C. or 700° C. to 900° C. In various embodiments, cold working may be performed on a nickel-titanium alloy article at an initial internal or surface temperature less than 500° C. such as ambient temperature, for example.

By way of example, a cast nickel-titanium alloy ingot may be hot forged to produce a nickel-titanium alloy billet. The nickel-titanium alloy billet may be hot bar rolled, for example, to produce nickel-titanium alloy round bar stock having a diameter larger than a specified final diameter for a bar or rod mill product. The larger diameter nickel-titanium alloy round bar stock may be a semi-finished mill product or intermediate workpiece that is subsequently cold drawn, for example, to produce a bar or rod mill product having a final specified diameter. The cold working of the nickel-titanium alloy workpiece may break-up and move non-metallic inclusions along the drawing direction and reduce the size of the non-metallic inclusions in the workpiece. The cold working may also increase the porosity in the nickel-titanium alloy workpiece, adding to any porosity present in the workpiece resulting from the prior hot working operations. A subsequent hot isostatic pressing operation may reduce or completely eliminate the porosity in the nickel-titanium alloy workpiece. A subsequent hot isostatic pressing operation may also simultaneously recrystallize the nickel-titanium alloy workpiece and/or provide a stress relief anneal to the workpiece.

Nickel-titanium alloys exhibit rapid cold work hardening and, therefore, cold worked nickel-titanium alloy articles may be annealed after successive cold working operations. For example, a process for producing a nickel-titanium alloy mill product may comprise cold working a nickel-titanium alloy workpiece in a first cold working operation, annealing the cold worked nickel-titanium alloy workpiece, cold working the annealed nickel-titanium alloy workpiece in a second cold working operation, and hot isostatic pressing the twice cold worked nickel-titanium alloy workpiece. After the second cold working operation and before the hot isostatic pressing operation, the nickel-titanium alloy workpiece may be subjected to at least one additional annealing operation, and at least one additional cold working operation. The number of successive cycles of intermediate annealing and cold working between a first cold working operation and a hot isostatic pressing operation may be determined by the amount of cold work to be put into the workpiece and the work hardening rate of the particular nickel-titanium alloy composition. Intermediate anneals between successive cold working operations may be performed in a furnace operating at a temperature in the range of 700° C. to 900° C. or 750° C. to 850° C. Intermediate anneals between successive cold working operations may be performed for at least 20 seconds up to 2 hours or more furnace time, depending on the size of the material and the type of furnace.

In various embodiments, hot working and/or cold working operations may be performed to produce the final macrostructural form of a nickel-titanium alloy mill product, and a subsequent hot isostatic pressing operation may be performed on the cold worked workpiece to produce the final microstructural form of the nickel-titanium alloy mill product. Unlike the use of hot isostatic pressing for the consolidation and sintering of metallurgical powders, the use of hot isostatic pressing in the processes described in this specification does not cause a macroscopic dimensional or shape change in the cold worked nickel-titanium alloy workpiece.

While not intending to be bound by theory, it is believed that cold working is significantly more effective than hot working at breaking-up and moving the friable (i.e., hard and non-ductile) non-metallic inclusions in nickel-titanium alloys, which decreases the sizes of the non-metallic inclusions. During working operations, the strain energy input into the nickel-titanium alloy material causes the larger non-metallic inclusions to fracture into smaller inclusions that move apart in the direction of the strain. During hot working at elevated temperatures, the plastic flow stress of the nickel-titanium alloy material is significantly lower; therefore, the material more easily flows around the inclusions and does not impart as much strain energy into the inclusions to cause fracture and movement. However, during hot working, the plastic flow of the alloy material relative to the inclusions still creates void spaces between the inclusions and the nickel-titanium alloy material, thereby increasing the porosity of the material. On the other hand, during cold working, the plastic flow stress of the nickel-titanium alloy material is significantly greater and the material does not plastically flow around the inclusions as readily. Therefore, significantly more strain energy is imparted to the inclusions to cause fracture and movement, which significantly increases the rate of inclusion fracture, movement, size reduction, and area reduction, but also increases the rate of void formation and porosity. As previously described, however, while working a nickel-titanium alloy may decrease the size and area fraction of non-metallic inclusions, the net result may be to increase the total size and area fraction of non-metallic inclusions combined with porosity.

The inventors have found that hot isostatic pressing a hot worked and/or cold worked nickel-titanium alloy workpiece will effectively close (i.e., "heal") the porosity formed in the alloy during hot working and/or cold working operations. The hot isostatic pressing causes the alloy material to plastically yield on a microscopic scale and close the void spaces that form the internal porosity in nickel-titanium alloys. In this manner, the hot isostatic pressing allows for micro-creep of the nickel-titanium alloy material into the void spaces. In addition, because the inside surfaces of the porosity voids have not been exposed to atmosphere, a metallurgical bond is created when the surfaces come together from the pressure of the HIP operation. This results in decreased size and area fraction of the non-metallic inclusions, which are separated by nickel-titanium alloy material instead of void spaces. This is particularly advantageous for the production of nickel-titanium alloy mill products that meet the size and area fraction requirements of the ASTM F 2063-12 standard specification, measured after cold working, which sets strict limits on the aggregate size and area fraction of contiguous non-metallic inclusions and porosity voids (maximum allowable length dimension of 39.0 micrometers (0.0015 inch), and maximum area fraction of 2.8%).

In various embodiments, a hot isostatic pressing operation may serve multiple functions. For example, a hot isostatic pressing operation may reduce or eliminate porosity in hot worked and/or cold worked nickel-titanium alloys, and the hot isostatic pressing operation may simultaneously anneal the nickel-titanium alloy, thereby relieving any internal stresses induced by the prior cold working operations and, in some embodiments, recrystallizing the alloy to achieve a desired grain structure such as, for example, an ASTM grain size number (G) of 4 or larger (as measured in accordance with ASTM E112-12*: Standard Test Methods for Determining Average Grain Size*, which is incorporated by reference into this specification). In various embodiments, after the hot isostatic pressing, a nickel-titanium alloy mill product may be subjected to one or more finishing operations including, but not limited to, peeling, polishing, centerless grinding, blasting, pickling, straightening, sizing, honing, or other surface conditioning operations.

In various embodiments, the mill products produced by the processes described in this specification may comprise, for example, a billet, a bar, a rod, a tube, a slab, a plate, a sheet, a foil, or a wire.

In various embodiments, a nickel input material and a titanium input material may be vacuum arc remelted to produce a nickel-titanium alloy VAR ingot that is hot worked and/or cold worked and hot isostatic pressed in accordance with the embodiments described in this specification. The nickel input material may comprise electrolytic nickel or nickel powder, for example, and the titanium input material may be selected from the group consisting of titanium sponge, electrolytic titanium crystals, titanium powders, and iodide-reduced titanium crystal bar. The nickel input material and/or the titanium input material may comprise less pure forms of elemental nickel or titanium that have been refined, for example, by electron beam melting before the nickel input material and the titanium input material are alloyed together to form the nickel-titanium alloy. Alloying elements in addition to nickel and titanium, if present, may be added using elemental input materials known in the metallurgical arts. The nickel input material and the titanium input material (and any other intentional alloying input materials) may be mechanically compacted together to produce an input electrode for an initial VAR operation.

The initial near-equiatomic nickel-titanium alloy composition may be melted as accurately as possible to a predetermined composition (such as, for example, 50.8 atomic percent (approximately 55.8 weight percent) nickel, balance titanium and residual impurities) by including measured amounts of the nickel input material and the titanium input material in the input electrode for the initial VAR operation. In various embodiments, the accuracy of the initial near-equiatomic nickel-titanium alloy composition may be evaluated by measuring a transition temperature of the VAR ingot, such as, for example, by measuring at least one of the $A_s$, $A_f$, $M_s$, $M_f$, and $M_d$ of the alloy.

It has been observed that the transition temperatures of nickel-titanium alloys depend in large part on the chemical composition of the alloy. In particular, it has been observed that the amount of nickel in solution in the NiTi phase of a nickel-titanium alloy will strongly influence the transformation temperatures of the alloy. For example, the $M_s$ of a nickel-titanium alloy will generally decrease with increasing concentration of nickel in solid solution in the NiTi phase; whereas the $M_s$ of a nickel-titanium alloy will generally increase with decreasing concentration of nickel in solid solution in the NiTi phase. The transformation temperatures of nickel-titanium alloys are well characterized for given alloy compositions. As such, measurement of a transformation temperature, and comparison of the measured value to an expected value corresponding to the target chemical composition of the alloy, may be used to determine any deviation from the target chemical composition of the alloy.

Transformation temperatures of a VAR ingot or other intermediate or final mill product may be measured, for example, using differential scanning calorimetry (DSC) or an equivalent thermomechanical test method. In various embodiments, a transformation temperature of a near-equiatomic nickel-titanium alloy VAR ingot may be measured according to ASTM F2004-05*: Standard Test Method for Transformation Temperature of Nickel-Titanium Alloys by Thermal Analysis*, which is incorporated by reference into this specification. Transformation temperatures of a VAR ingot or other intermediate or final mill product may also be measured, for example, using bend free recovery (BFR) testing according to ASTM F2082-06*: Standard Test Method for Determination of Transformation Temperature of Nickel-Titanium Shape Memory Alloys by Bend and Free Recovery*, which is incorporated by reference into this specification.

When a measured transformation temperature deviates from a predetermined specification for the expected transformation temperature of the target alloy composition, the initial VAR ingot may be re-melted in a second VAR operation with a corrective addition of a nickel input material, a titanium input material, or a nickel-titanium master alloy having a known transition temperature. A transformation temperature of the resulting second nickel-titanium alloy VAR ingot may be measured to determine whether the transformation temperature falls within the predetermined specification for the expected transformation temperature of the target alloy composition. The predetermined specification may be a temperature range about the expected transition temperature of the target composition.

If a measured transition temperature of a second nickel-titanium VAR ingot falls outside the predetermined specification, the second VAR ingot, and, if necessary, subsequent VAR ingots, may be re-melted in successive VAR operations with corrective alloying additions until a measured transformation temperature falls within the predetermined specification. This iterative re-melting and alloying practice allows for accurate and precise control over the near-equiatomic nickel-titanium alloy composition and transformation temperature. In various embodiments, the $A_f$, and/or $A_p$ is/are used to iteratively re-melt and alloy a near-equiatomic nickel-titanium alloy (the austenite peak temperature ($A_p$) is the temperature at which a nickel-titanium shape-memory or superelastic alloy exhibits the highest rate of transformation from martensite to austenite, see ASTM F2005-05*: Standard Terminology for Nickel-Titanium Shape Memory Alloys*, incorporated by reference into this specification).

In various embodiments, a titanium input material and a nickel input material may be vacuum induction melted to produce a nickel-titanium alloy, and an ingot of the nickel-titanium alloy may be cast from the VIM melt. The VIM cast ingot may be hot worked and/or cold worked and hot isostatic pressed in accordance with the embodiments described in this specification. The nickel input material may comprise electrolytic nickel or nickel powder, for example, and the titanium input material may be selected from the group consisting of titanium sponge, electrolytic titanium crystals, titanium powders, and iodide-reduced titanium crystal bar. The nickel input material and the titanium input material may be charged to a VIM crucible, melted together, and cast into an initial VIM ingot.

The initial near-equiatomic nickel-titanium alloy composition may be melted as accurately as possible to a predetermined composition (such as, for example, 50.8 atomic percent (approximately 55.8 weight percent) nickel, titanium, and residual impurities) by including measured amounts of the nickel input material and the titanium input material in the charge to the VIM crucible. In various embodiments, the accuracy of the initial near-equiatomic nickel-titanium alloy composition may be evaluated by measuring a transition temperature of the VIM ingot or other intermediate or final mill product, as described above in connection with the nickel-titanium alloy prepared using VAR. If a measured transition temperature falls outside a predetermined specification, the initial VIM ingot, and, if necessary, subsequent VIM ingots or other intermediate or final mill products, may be re-melted in successive VIM operations with corrective alloying additions until a measured transformation temperature falls within the predetermined specification.

In various embodiments, a nickel-titanium alloy may be produced using a combination of one or more VIM operations and one or more VAR operations. For example, a nickel-titanium alloy ingot may be prepared from nickel input materials and titanium input materials using a VIM operation to prepare an initial ingot, which is then remelted in a VAR operation. A bundled VAR operation may also be used in which a plurality of VIM ingots are used to construct a VAR electrode.

In various embodiments, a nickel-titanium alloy may comprise 45.0 atomic percent to 55.0 atomic percent nickel, balance titanium and residual impurities. The nickel-titanium alloy may comprise 45.0 atomic percent to 56.0 atomic percent nickel or any sub-range subsumed therein, such as, for example, 49.0 atomic percent to 52.0 atomic percent nickel. The nickel-titanium alloy may also comprise 50.8 atomic percent nickel (±0.5, ±0.4, ±0.3, ±0.2, or ±0.1 atomic percent nickel), balance titanium and residual impurities. The nickel-titanium alloy may also comprise 55.04 atomic percent nickel (±0.10, ±0.05, ±0.04, ±0.03, ±0.02, or ±0.01 atomic percent nickel), balance titanium and residual impurities.

In various embodiments, a nickel-titanium alloy may comprise 50.0 weight percent to 60.0 weight percent nickel, balance titanium and residual impurities. The nickel-titanium alloy may comprise 50.0 weight percent to 60.0 weight percent nickel or any sub-range subsumed therein, such as, for example, 54.2 weight percent to 57.0 weight percent nickel. The nickel-titanium alloy may comprise 55.8 weight percent nickel (±0.5, ±0.4, ±0.3, ±0.2, or ±0.1 weight percent nickel), balance titanium and residual impurities. The nickel-titanium alloy may comprise 54.5 weight percent nickel (±2, ±1, ±0.5, ±0.4, ±0.3, ±0.2, or ±0.1 weight percent nickel), balance titanium and residual impurities.

The various embodiments described in this specification are also applicable to shape-memory or superelastic nickel-titanium alloys comprising at least one alloying element in addition to nickel and titanium, such as, for example, copper, iron, cobalt, niobium, chromium, hafnium, zirconium, platinum, and/or palladium. In various embodiments, a shape-memory or superelastic nickel-titanium alloy may comprise nickel, titanium, residual impurities, and 1.0 atomic percent to 30.0 atomic percent of at least one other alloying element, such as, for example, copper, iron, cobalt, niobium, chromium, hafnium, zirconium, platinum, and palladium. For example, a shape-memory or superelastic nickel-titanium alloy may comprise nickel, titanium, residual impurities, and 5.0 atomic percent to 30.0 atomic percent hafnium, zirconium, platinum, palladium, or a combination of any thereof. In various embodiments, a shape-memory or superelastic nickel-titanium alloy may comprise nickel, titanium, residual impurities, and 1.0 atomic percent to 5.0 atomic percent copper, iron, cobalt, niobium, chromium, or a combination of any thereof.

The non-limiting and non-exhaustive examples that follow are intended to further describe various non-limiting and non-exhaustive embodiments without restricting the scope of the embodiments described in this specification.

EXAMPLES

Example 1

A 0.5-inch diameter nickel-titanium alloy bar was cut into seven (7) bar samples. The sections were respectively treated as indicated in Table 1.

TABLE 1

| Sample Number | Treatment |
|---|---|
| 1 | None |
| 2 | HIP'ed: 800° C.; 15,000 psi; 2 hours |
| 3 | HIP'ed: 850° C.; 15,000 psi; 2 hours |
| 4 | HIP'ed: 900° C.; 15,000 psi; 2 hours |
| 5 | HIP'ed: 800° C.; 45,000 psi; 2 hours |

TABLE 1-continued

| Sample Number | Treatment |
|---|---|
| 6 | HIP'ed: 850° C.; 45,000 psi; 2 hours |
| 7 | HIP'ed: 900° C.; 45,000 psi; 2 hours |

After the hot isostatic pressing treatment, Samples 2-7 were each sectioned longitudinally at the approximate centerline of the samples to produce samples for scanning electron microscopy (SEM). Sample 1 was sectioned longitudinally in the as-received condition without any hot isostatic pressing treatment. The maximum size and area fraction of contiguous non-metallic inclusions and porosity voids were measured in accordance with ASTM E1245-03 (2008)—*Standard Practice for Determining the Inclusion or Second-Phase Constituent Content of Metals by Automatic Image Analysis*. The full longitudinal cross-sections were inspected using SEM in backscatter electron mode. SEM fields containing the three largest visible regions of contiguous non-metallic inclusions and porosity were imaged at 500× magnification for each sectioned sample. Image analysis software was used to measure the maximum size and the area fraction of the non-metallic inclusions and porosity in each of the three SEM images per sectioned sample. The results are presented in Tables 2 and 3.

TABLE 2

Figure 4A:
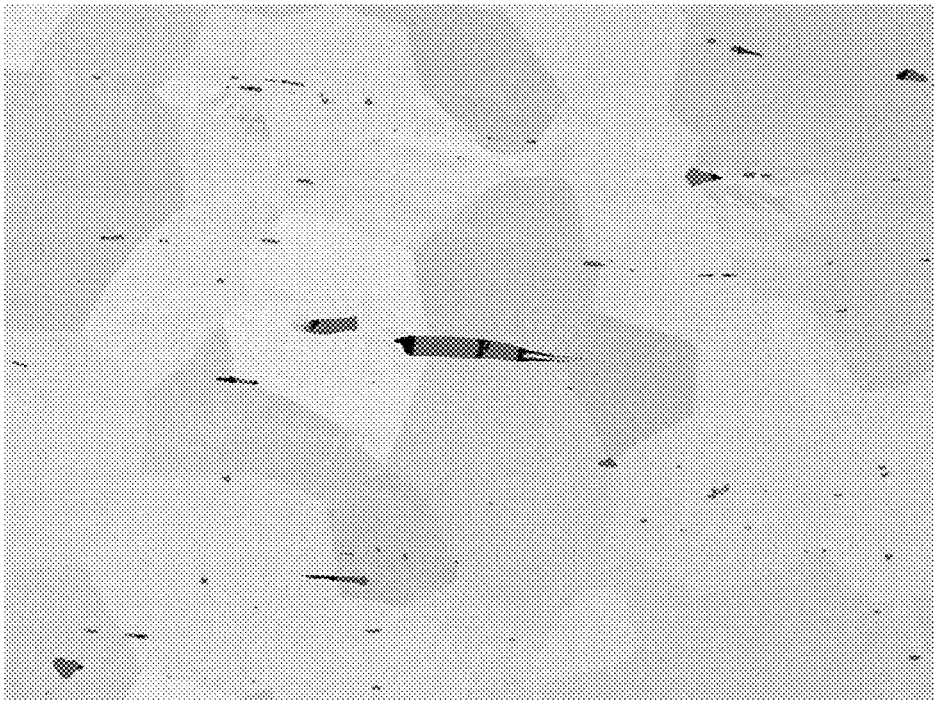
FIGS. 4A-4G are scanning electron microscopy images (500× magnification in backscatter electron mode) of nickel-titanium alloys processed in accordance with embodiments described in this specification.
Figure 4B:
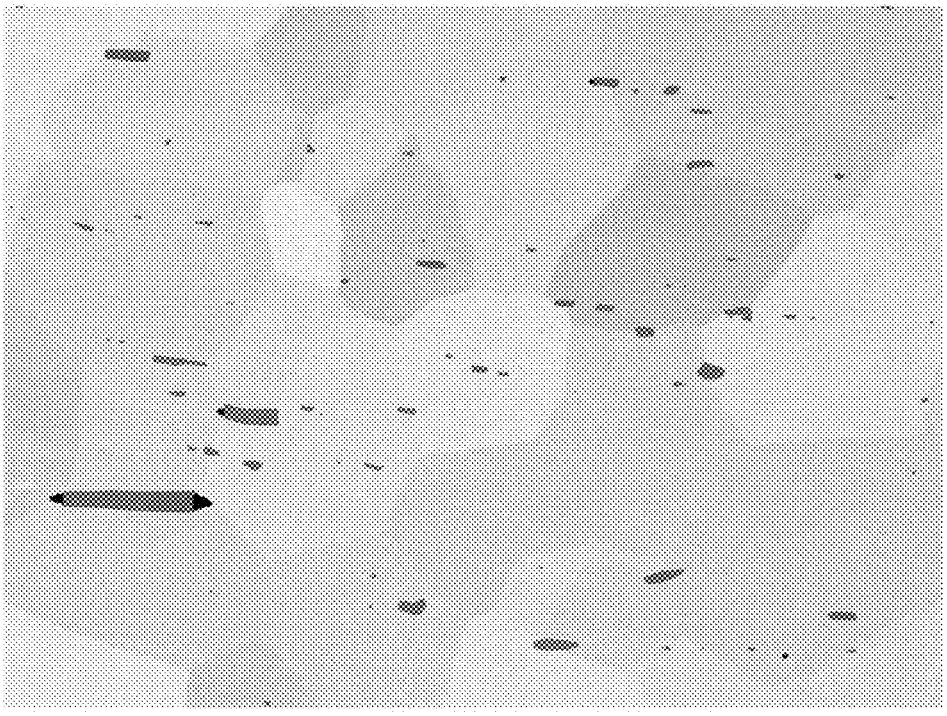
Figure 4C:
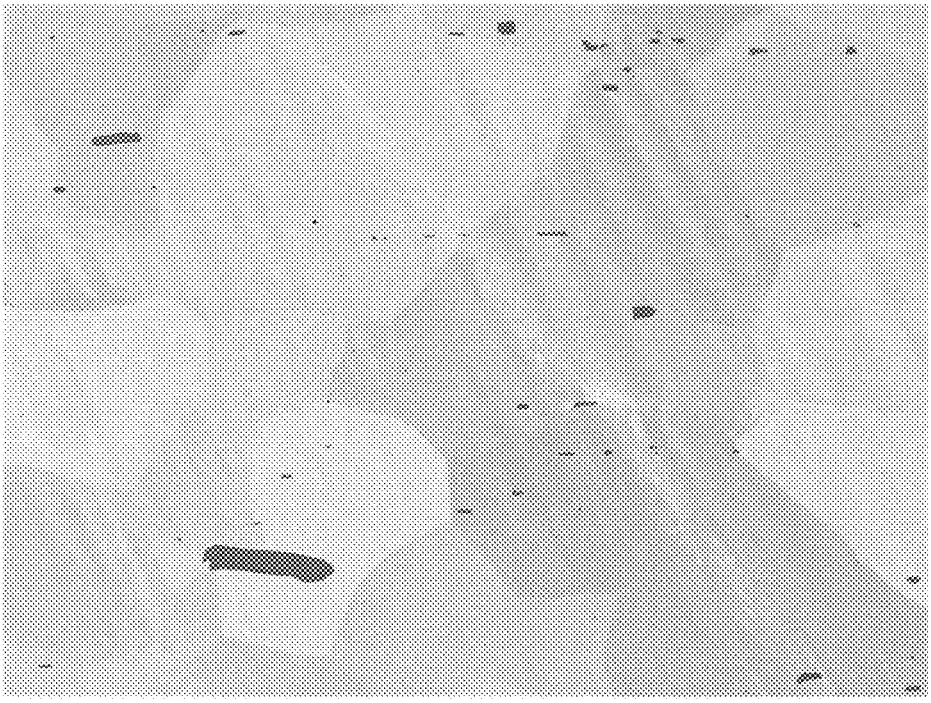
Figure 4D:
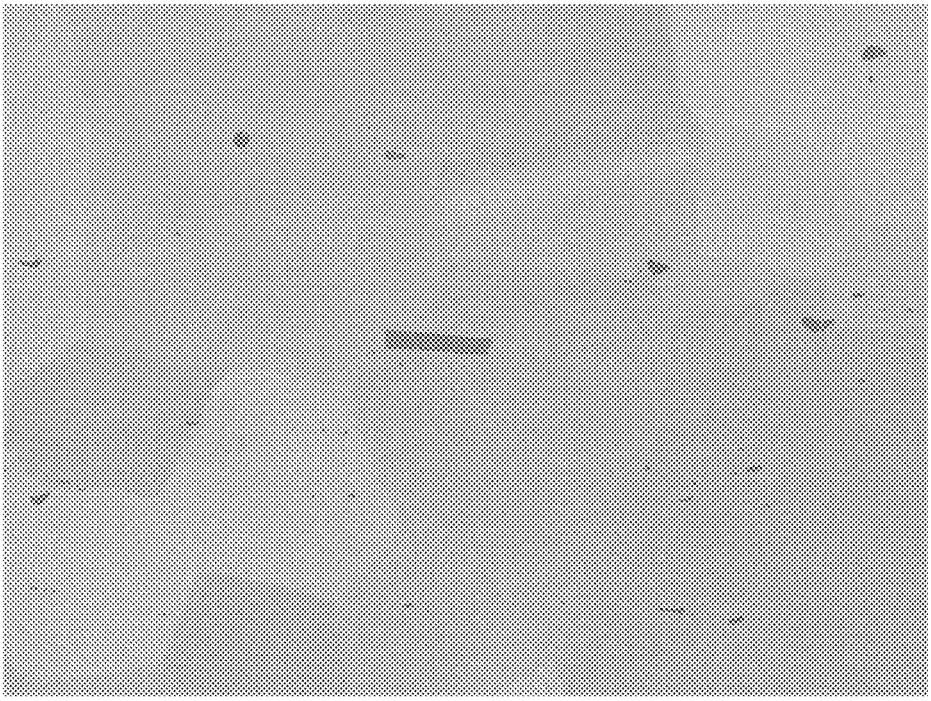
Figure 4E:
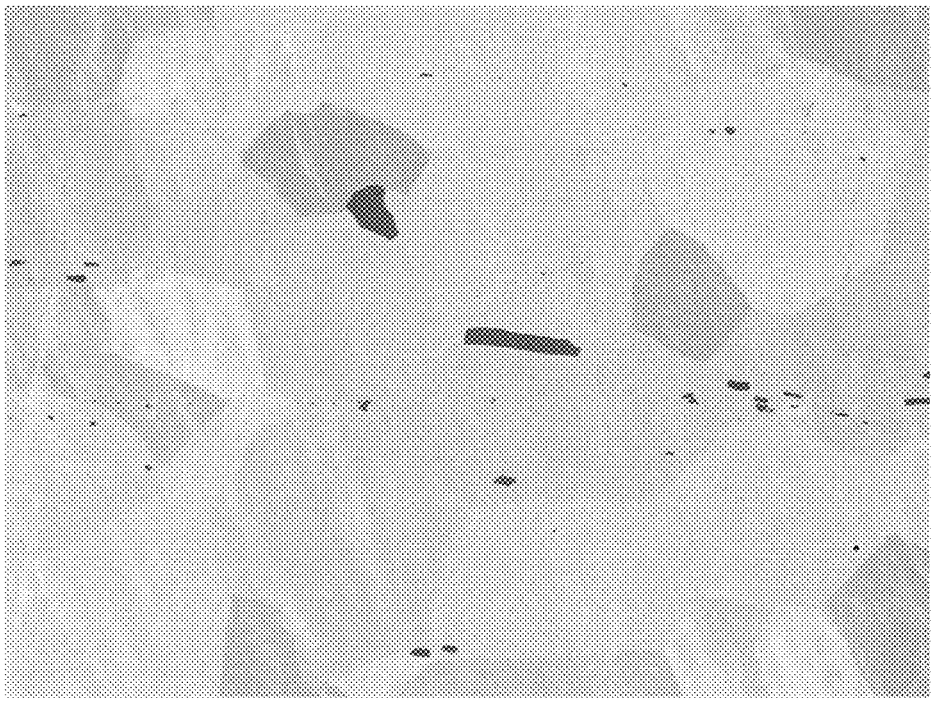
Figure 4F:
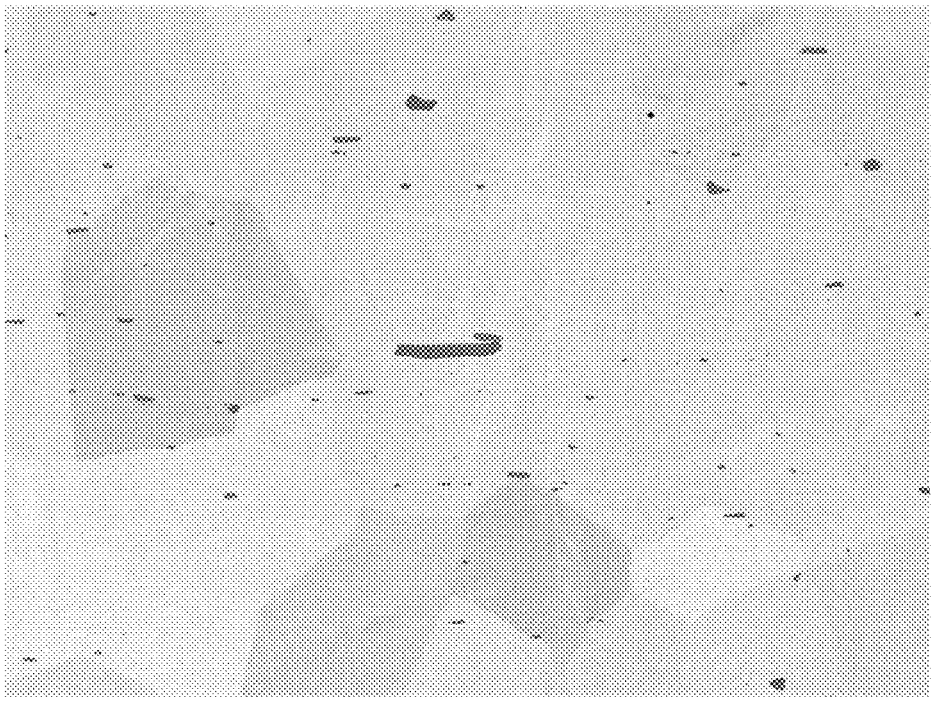
Figure 4G:
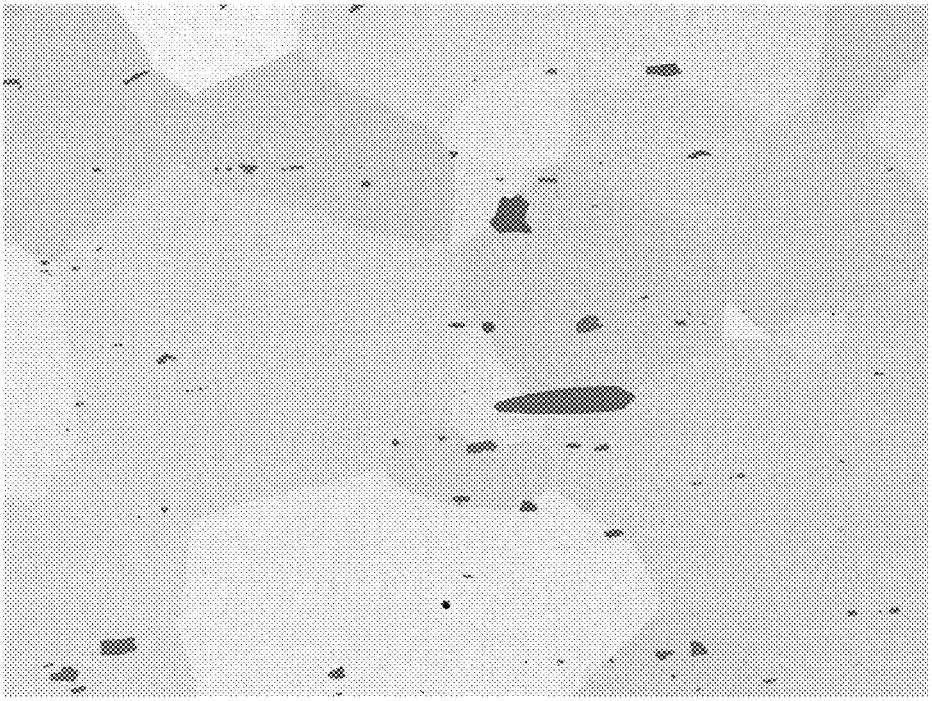

| Sample Number | Maximum Inclusion Dimension (micrometers) | Maximum Area Fraction (%) | SEM Image Corresponding to Maximum Inclusion Dimension |
|---|---|---|---|
| 1 | 51.5 | 1.88 | FIG. 4A |
| 2 | 43.6 | 2.06 | FIG. 4B |
| 3 | 35.9 | 1.44 | FIG. 4C |
| 4 | 29.4 | 1.46 | FIG. 4D |
| 5 | 32.1 | 1.87 | FIG. 4E |
| 6 | 29.4 | 1.86 | FIG. 4F |
| 7 | 38.8 | 1.84 | FIG. 4G |

TABLE 3

| Sample Number | Average of the Three Maximum Inclusion Dimensions (micrometers) | Average of the Three Maximum Area Fractions (%) |
|---|---|---|
| 1 | 49.1 | 1.57 |
| 2 | 39.3 | 1.73 |
| 3 | 33.8 | 1.28 |
| 4 | 27.7 | 1.18 |
| 5 | 30.1 | 1.42 |
| 6 | 28.8 | 1.49 |
| 7 | 34.8 | 1.55 |

The results show that the hot isostatic pressing operations generally decreased the combined sizes and area fractions of the non-metallic inclusions and porosity. The hot isostatic pressed nickel-titanium alloy bars generally met the requirements of the ASTM F 2063-12 standard specification (maximum allowable length dimension of 39.0 micrometers (0.0015 inch), and maximum area fraction of 2.8%). A comparison of FIGS. 4B-4G with FIG. 4A shows that the hot isostatic pressing operations decreased and in some cases eliminated porosity in the nickel-titanium alloy bars.

Example 2

A 0.5-inch diameter nickel-titanium alloy bar was cut into seven (7) bar samples. The samples were respectively treated as indicated in Table 4.

TABLE 4

| Sample Number | Treatment |
|---|---|
| 1 | None |
| 2 | HIP'ed: 800° C.; 15,000 psi; 2 hours |
| 3 | HIP'ed: 850° C.; 15,000 psi; 2 hours |
| 4 | HIP'ed: 900° C.; 15,000 psi; 2 hours |
| 5 | HIP'ed: 800° C.; 45,000 psi; 2 hours |
| 6 | HIP'ed: 850° C.; 45,000 psi; 2 hours |
| 7 | HIP'ed: 900° C.; 45,000 psi; 2 hours |

After the hot isostatic pressing treatment, Samples 2-7 were each sectioned longitudinally at the approximate centerline of the samples to produce sections for scanning electron microscopy (SEM). Samples 1 was sectioned longitudinally in the as-received condition without any hot isostatic pressing treatment. The maximum size and area fraction of contiguous non-metallic inclusions and porosity voids were measured in accordance with ASTM E1245-03 (2008)—*Standard Practice for Determining the Inclusion or Second-Phase Constituent Content of Metals by Automatic Image Analysis*. The full longitudinal cross-sections were inspected using SEM in backscatter electron mode. SEM fields containing the three largest visible regions of contiguous non-metallic inclusions and porosity were imaged at 500× magnification for each sectioned sample. Image analysis software was used to measure the maximum size and the area fraction of the non-metallic inclusions and porosity in each of the three SEM images per sectioned sample. The results are presented in Tables 5 and 6.

TABLE 5

Figure 5A:
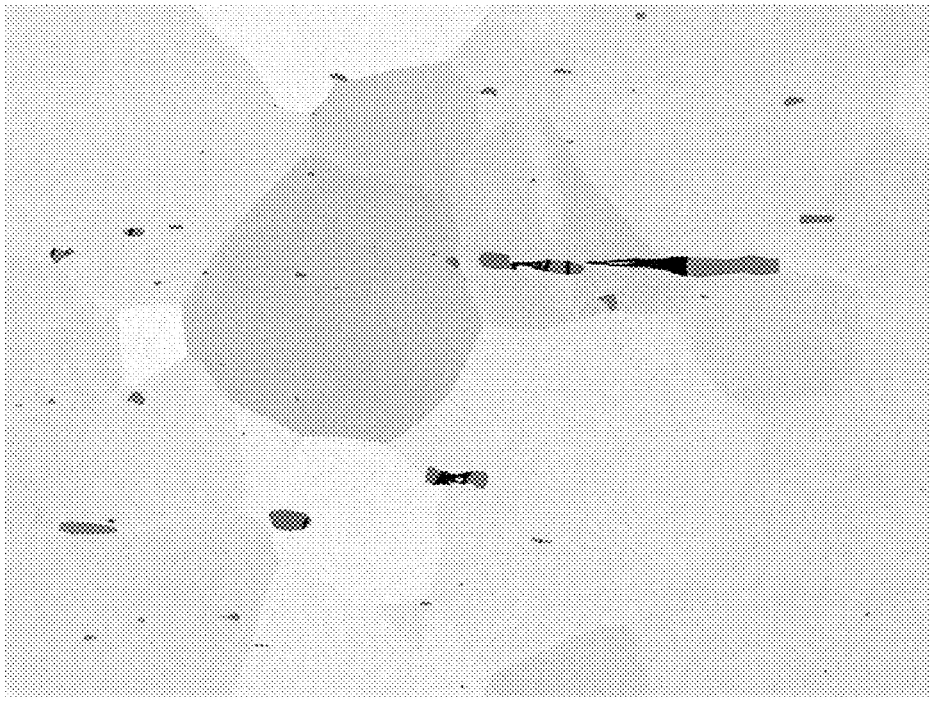
FIGS. 5A-5G are scanning electron microscopy images (500× magnification in backscatter electron mode) of nickel-titanium alloys processed in accordance with embodiments described in this specification.
Figure 5B:
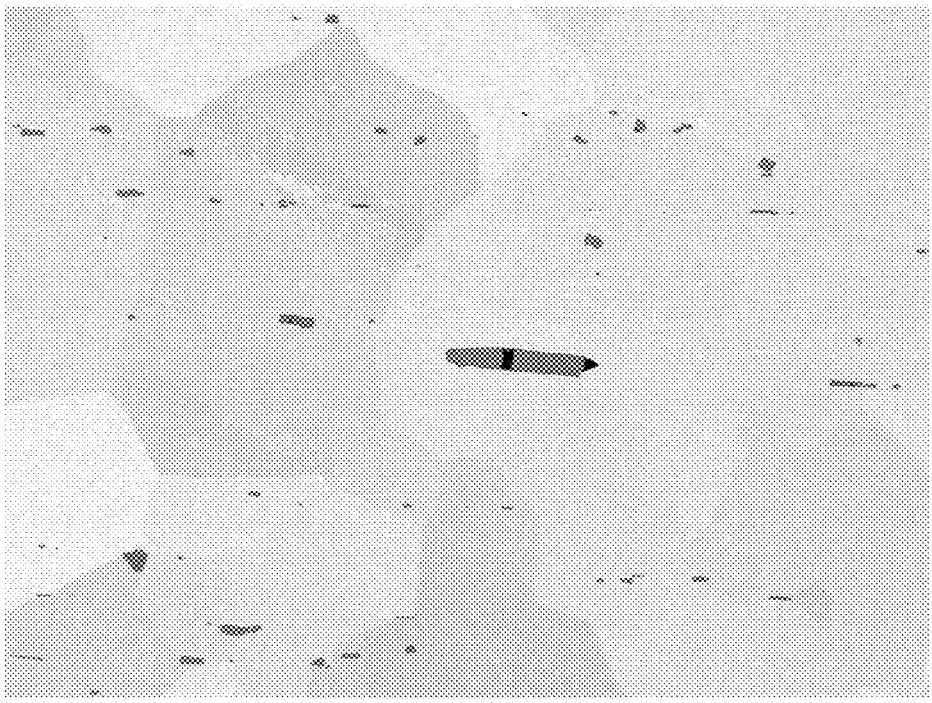
Figure 5C:
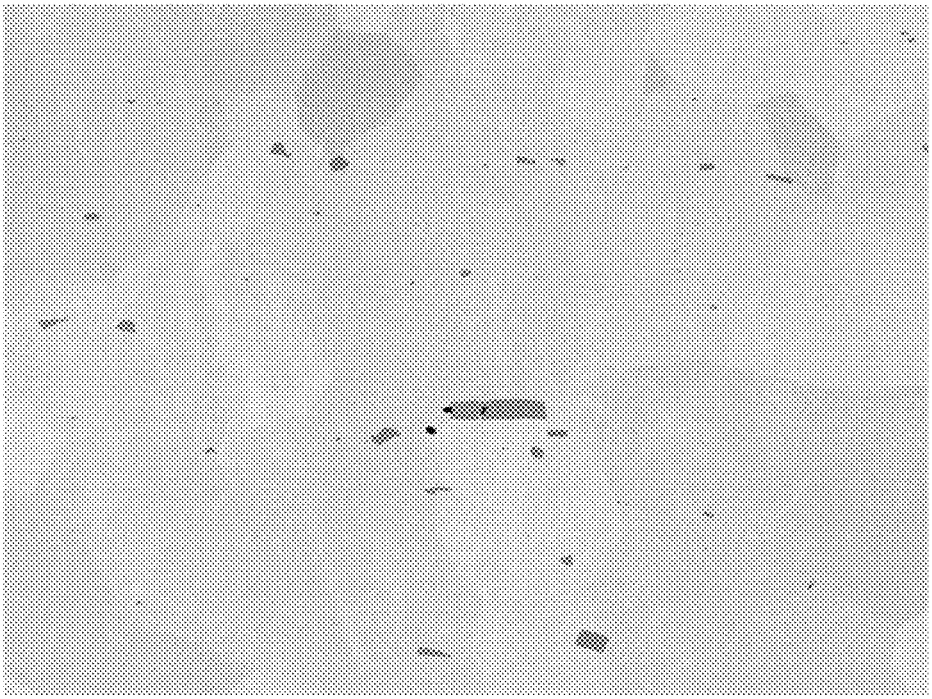
Figure 5D:
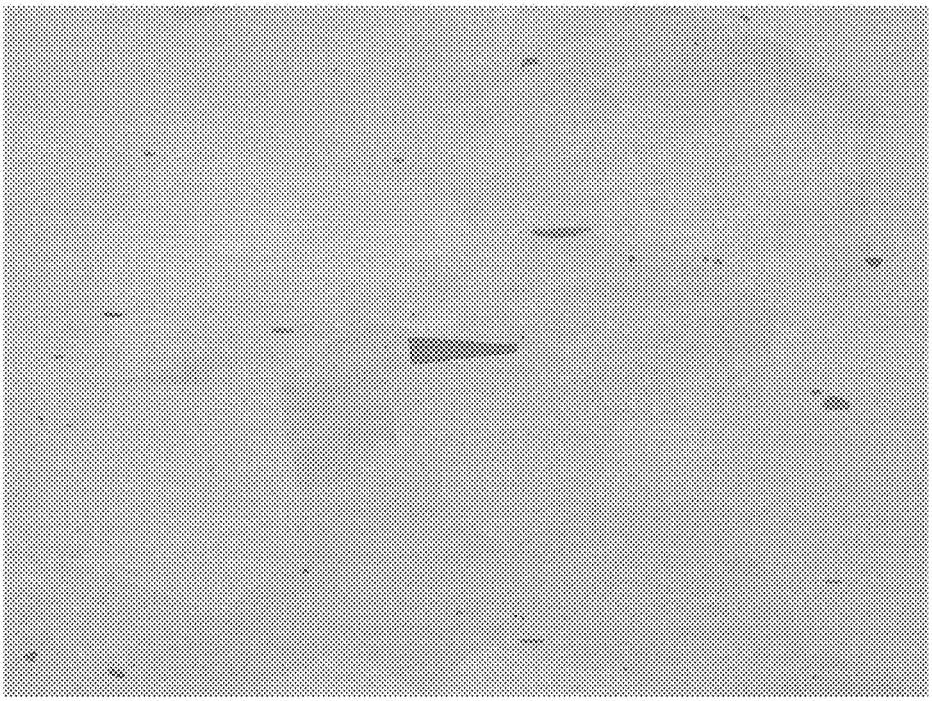
Figure 5E:
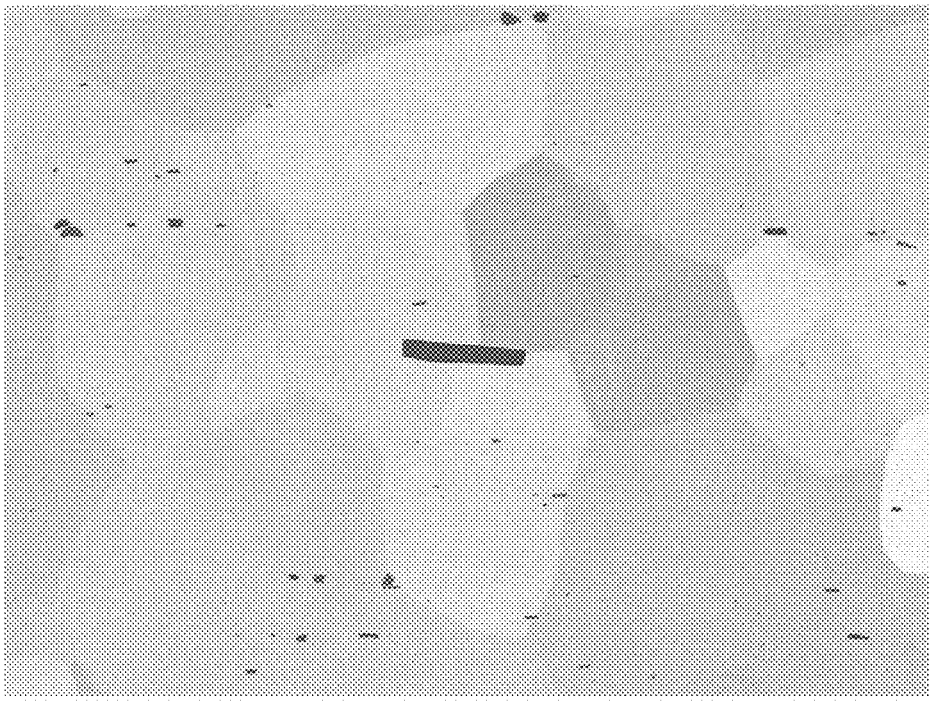
Figure 5F:
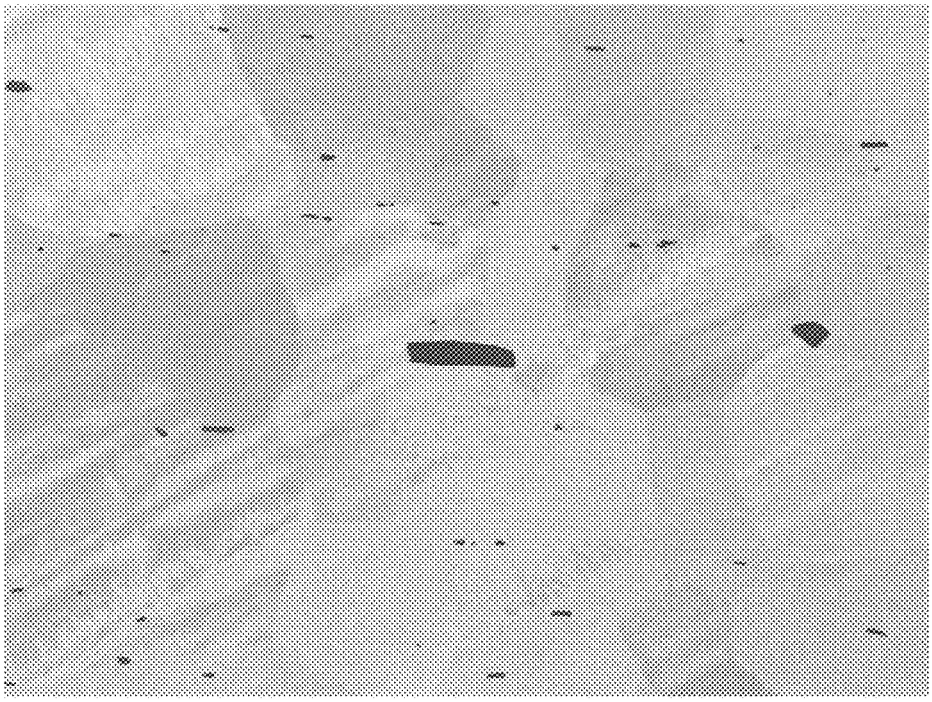
Figure 5G:
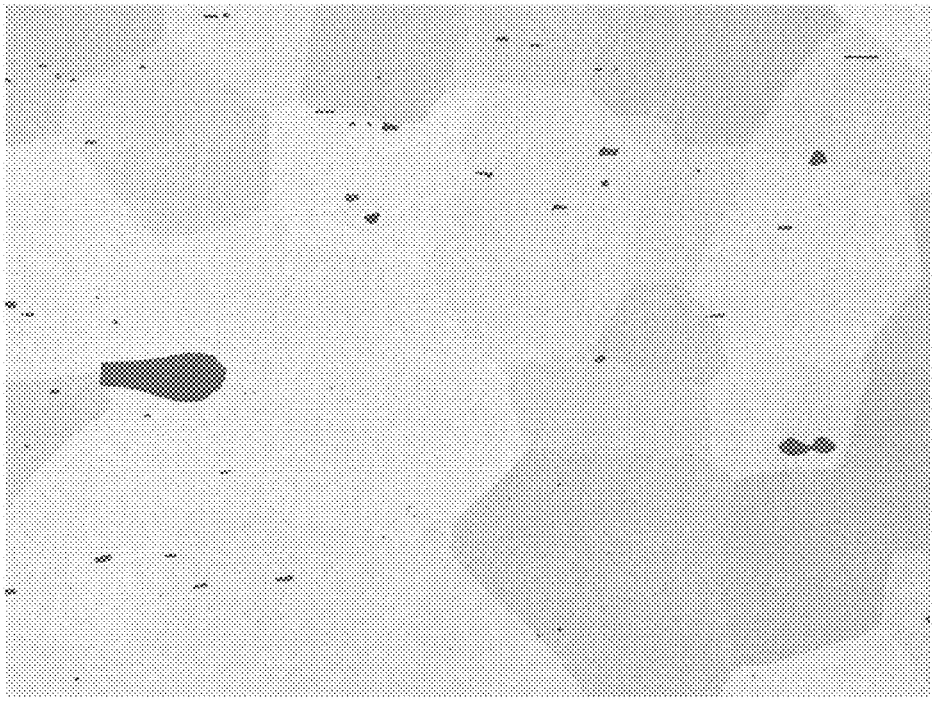

| Sample Number | Maximum Inclusion Dimension (micrometers) | Maximum Area Fraction (%) | SEM Image Corresponding to Maximum Inclusion Dimension |
|---|---|---|---|
| 1 | 52.9 | 1.63 | FIG. 5A |
| 2 | 41.7 | 1.23 | FIG. 5B |
| 3 | 28.3 | 1.63 | FIG. 5C |
| 4 | 29.9 | 0.85 | FIG. 5D |
| 5 | 34.1 | 0.95 | FIG. 5E |
| 6 | 30.2 | 1.12 | FIG. 5F |
| 7 | 34.7 | 1.25 | FIG. 5G |

TABLE 6

| Section Number | Average of Three Maximum Inclusion Dimensions (micrometers) | Average of Three Maximum Area Fractions (%) |
|---|---|---|
| 1 | 49.0 | 1.45 |
| 2 | 37.0 | 1.15 |
| 3 | 27.8 | 1.28 |
| 4 | 27.9 | 0.80 |
| 5 | 32.8 | 0.88 |
| 6 | 29.0 | 1.05 |
| 7 | 33.1 | 1.11 |

The results show that the hot isostatic pressing operations generally decreased the combined sizes and area fractions of the non-metallic inclusions and porosity. The hot isostatic pressed nickel-titanium alloy bars generally met the requirements of the ASTM F 2063-12 standard specification (maximum allowable length dimension of 39.0 micrometers (0.0015 inch), and maximum area fraction of 2.8%). A comparison of FIGS. 5B-5G with FIG. 5A shows that the hot isostatic pressing operations decreased and in some cases eliminated porosity in the nickel-titanium alloy bars.

Example 3

A 0.5-inch diameter nickel-titanium alloy bar was hot isostatic pressed for 2 hours at 900° C. and 15,000 psi. The hot isostatic pressed bar was sectioned longitudinally to produce eight (8) longitudinal sample sections for scanning electron microscopy (SEM). The maximum size and area fraction of contiguous non-metallic inclusions and porosity voids were measured in accordance with ASTM E1245-03 (2008)—*Standard Practice for Determining the Inclusion or Second-Phase Constituent Content of Metals by Automatic Image Analysis*. Each of the eight longitudinal cross-sections was inspected using SEM in backscatter electron mode. SEM fields containing the three largest visible regions of contiguous non-metallic inclusions and porosity were imaged at 500× magnification for each sample section. Image analysis software was used to measure the maximum size and the area fraction of the non-metallic inclusions and porosity in each of the three SEM images per sample section. The results are presented in Table 7.

TABLE 7

Figure 6A:
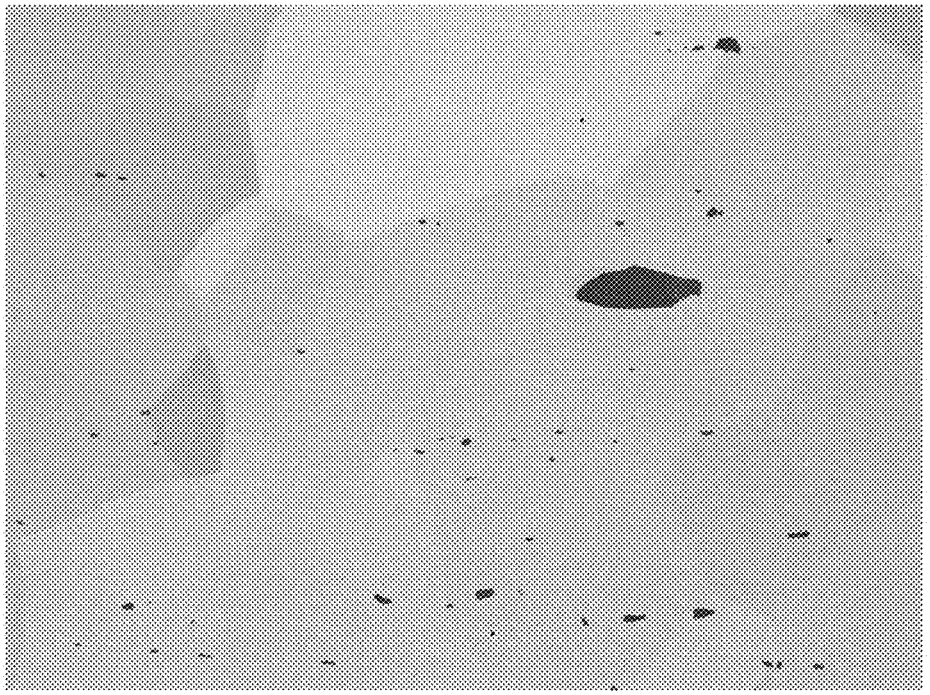
FIGS. 6A-6H are scanning electron microscopy images (500× magnification in backscatter electron mode) of nickel-titanium alloys processed in accordance with embodiments described in this specification.
Figure 6B:
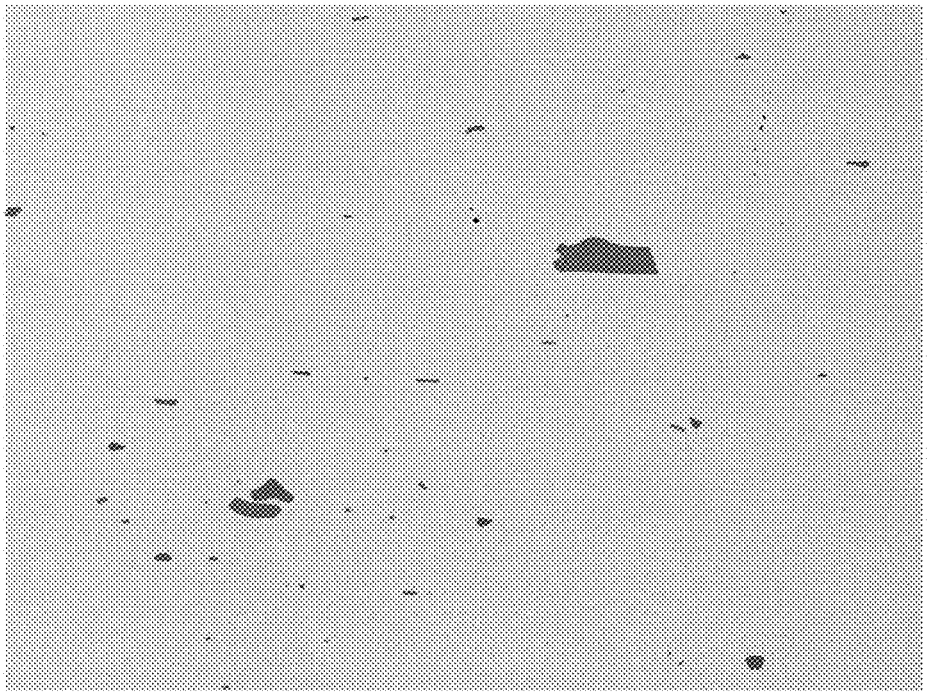
Figure 6C:
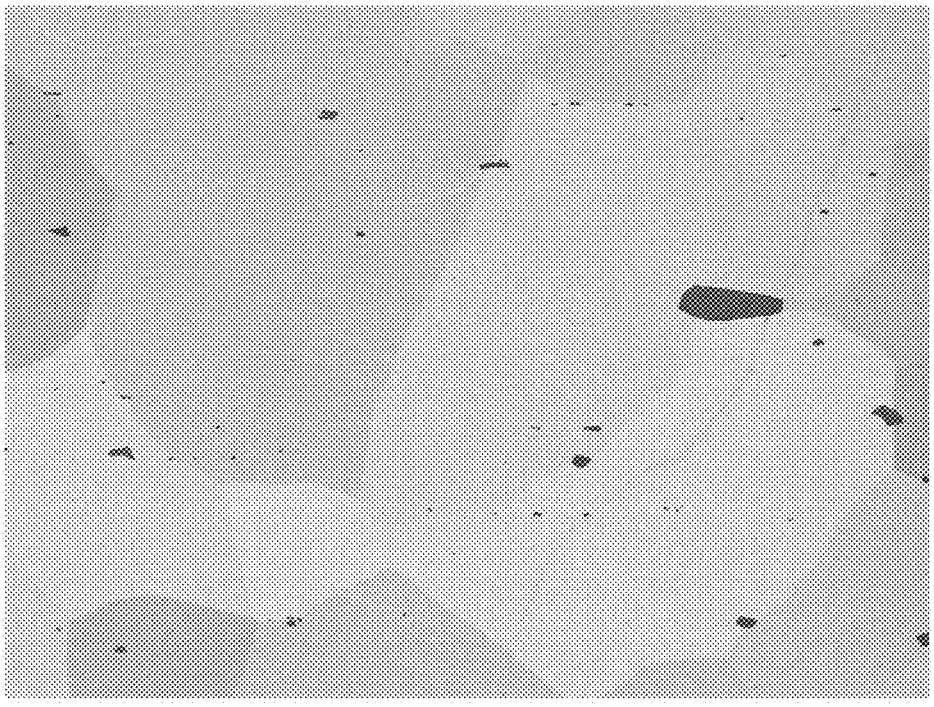
Figure 6D:
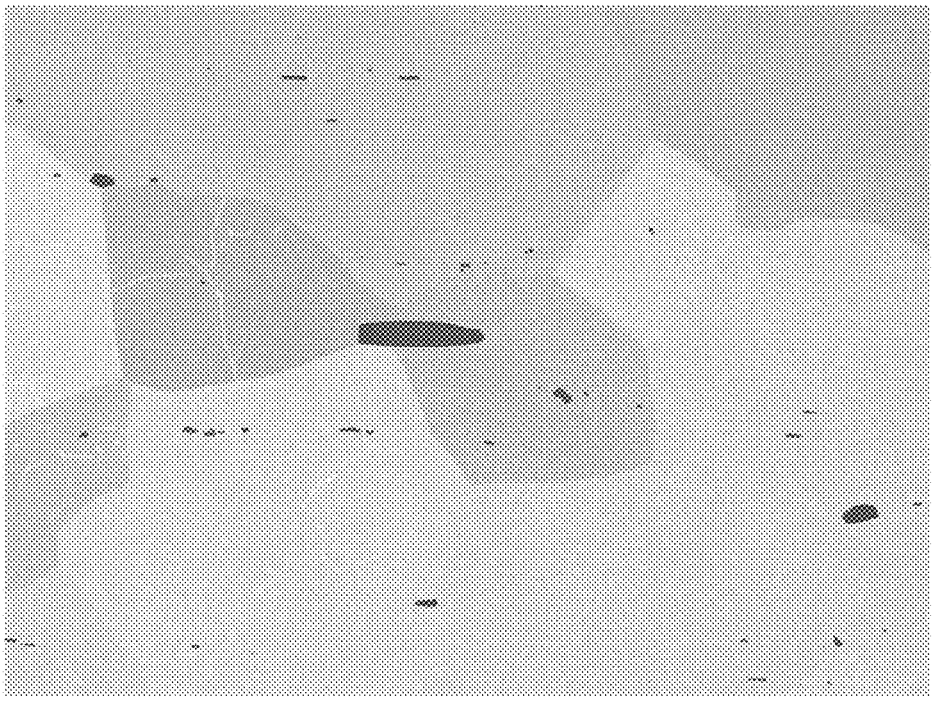
Figure 6E:
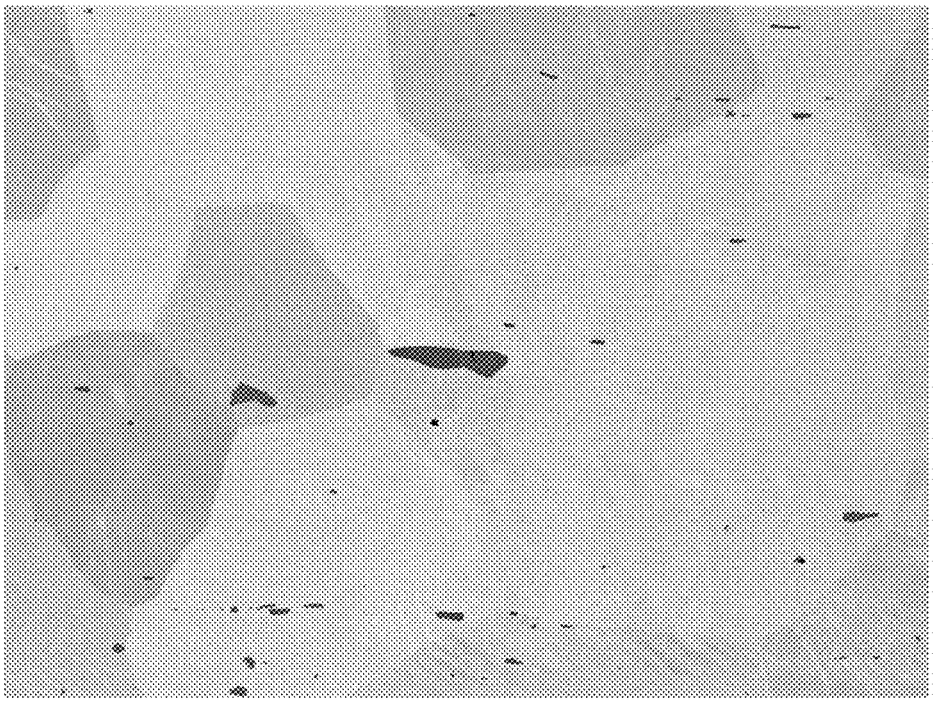
Figure 6F:
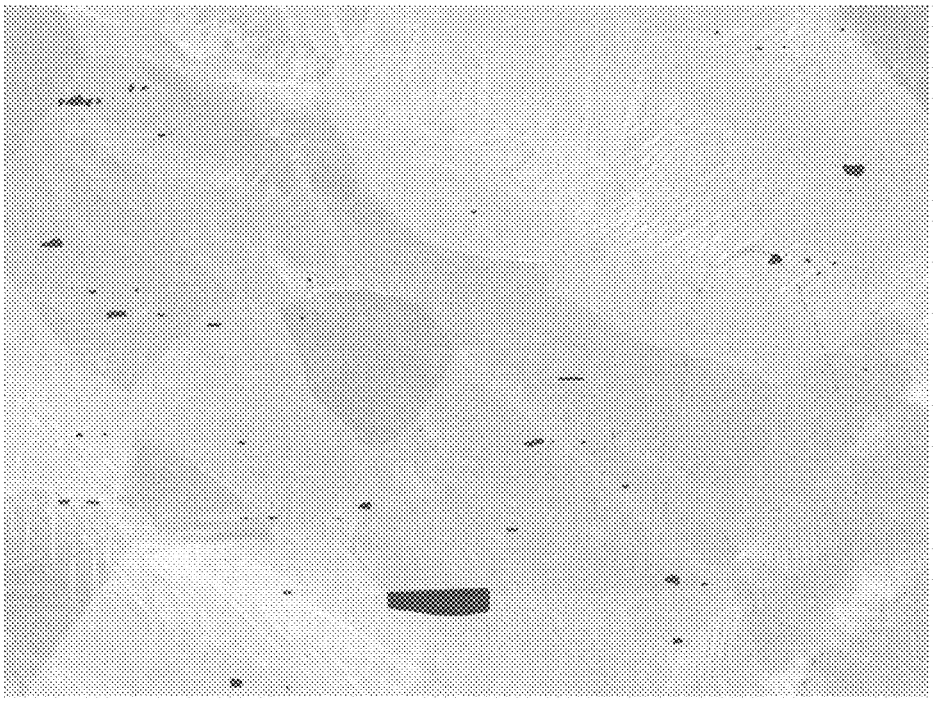
Figure 6G:
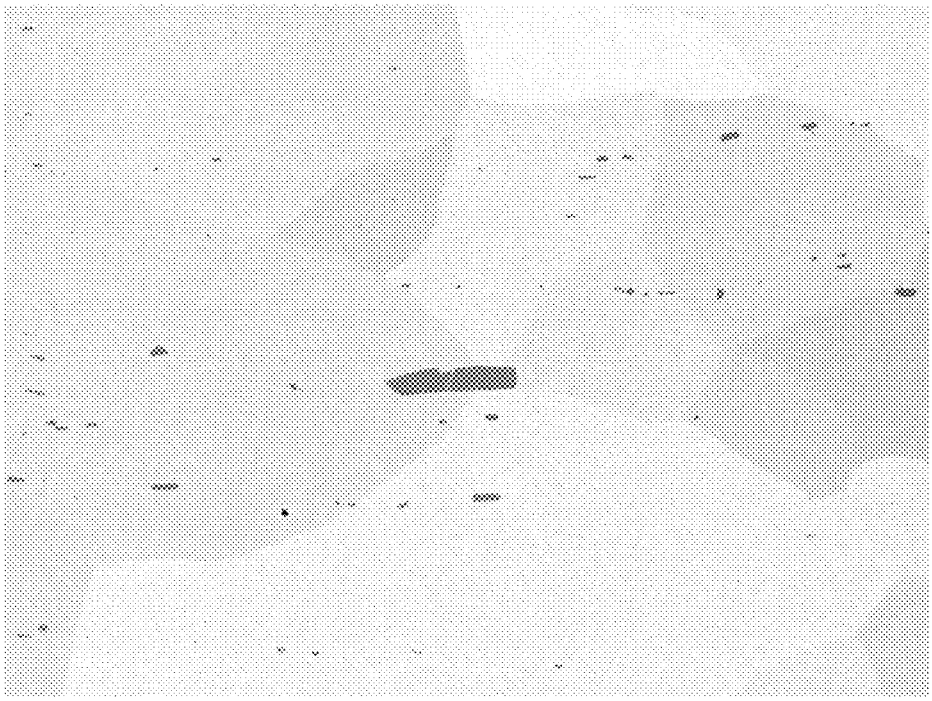
Figure 6H:
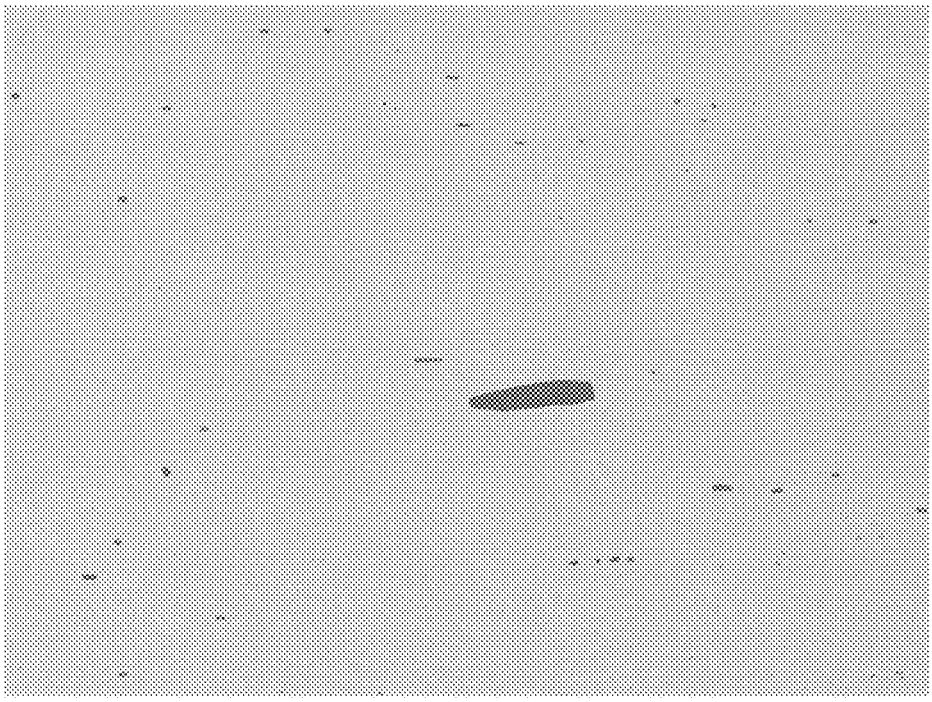

| Sample Section | Maximum Inclusion Dimension (micrometers) | Maximum Area Fraction (%) | SEM Image Corresponding to Maximum Inclusion Dimension |
|---|---|---|---|
| 1 | 34.7 | 1.15 | FIG. 6A |
| 2 | 29.0 | 1.09 | FIG. 6B |
| 3 | 28.7 | 1.23 | FIG. 6C |
| 4 | 34.7 | 1.20 | FIG. 6D |
| 5 | 32.8 | 1.42 | FIG. 6E |
| 6 | 28.3 | 1.23 | FIG. 6F |
| 7 | 35.4 | 0.95 | FIG. 6G |
| 8 | 34.4 | 1.03 | FIG. 6H |
| Average | 32.3 | 1.20 | — |

The results show that the hot isostatic pressed nickel-titanium alloy bars generally met the requirements of the ASTM F 2063-12 standard specification (maximum allowable length dimension of 39.0 micrometers (0.0015 inch), and maximum area fraction of 2.8%). A study of FIGS. 6A-6H shows that the hot isostatic pressing operations eliminated porosity in the nickel-titanium alloy bars.

Example 4

Two (2) 4.0-inch diameter nickel-titanium alloy billets (Billet-A and Billet-B) were each cut into two (2) smaller billets to produce a total of four (4) billet samples: A1, A2, B1, and B2. The sections were respectively treated as indicated in Table 8.

TABLE 8

| Billet Samples | Treatment (Billet-A) |
|---|---|
| A1 | None |
| A2 | HIP'ed: 900° C.; 15 ksi; 2 hours |
| B1 | None |
| B2 | HIP'ed: 900° C.; 15 ksi; 2 hours |

After the hot isostatic pressing treatment, Samples A2 and B2 were each sectioned longitudinally at the approximate centerline of the sections to produce samples for scanning electron microscopy (SEM). Samples A1 and B1 were sectioned longitudinally in the as-received condition without any hot isostatic pressing treatment. The maximum size and area fraction of contiguous non-metallic inclusions and porosity voids were measured in accordance with ASTM E1245-03 (2008)—*Standard Practice for Determining the Inclusion or Second-Phase Constituent Content of Metals by Automatic Image Analysis*. The full longitudinal cross-sections were inspected using SEM in backscatter electron mode. SEM fields containing the three largest visible regions of contiguous non-metallic inclusions and porosity were imaged at 500× magnification for each sectioned sample. Image analysis software was used to measure the maximum size and the area fraction of the non-metallic inclusions and porosity in each of the three SEM images per sectioned sample. The results are presented in Table 9.

TABLE 9

Figure 7A:
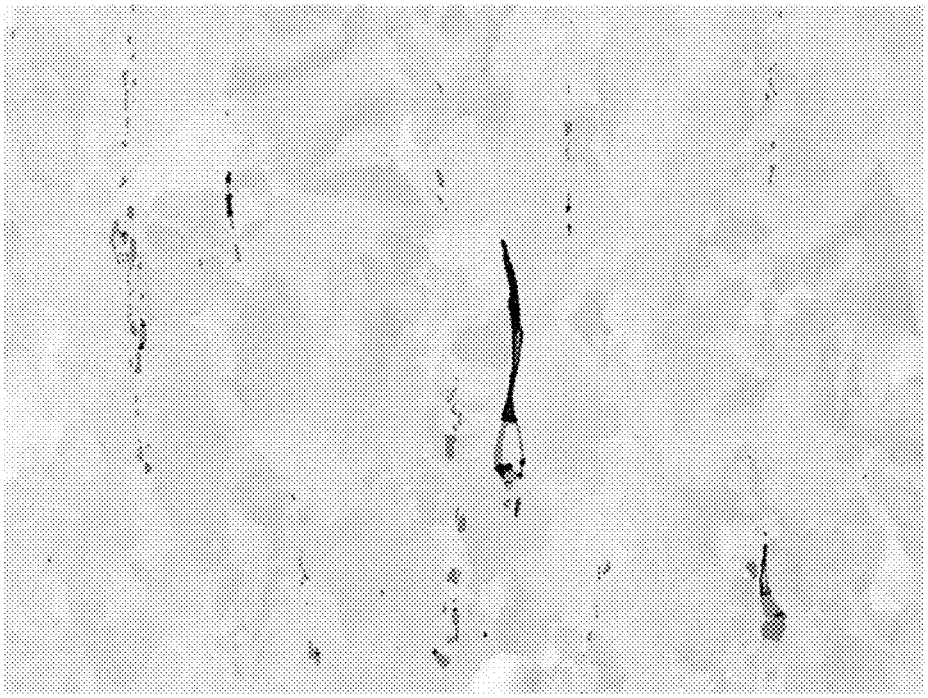
FIGS. 7A-7D are scanning electron microscopy images (500× magnification in backscatter electron mode) of nickel-titanium alloys processed in accordance with embodiments described in this specification.
Figure 7B:
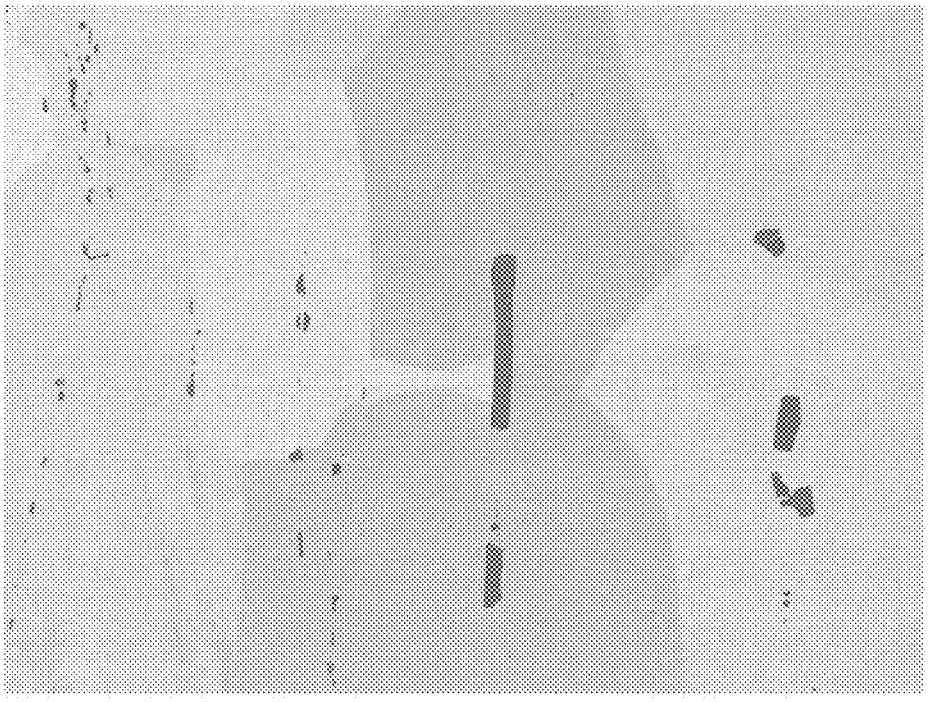
Figure 7C:
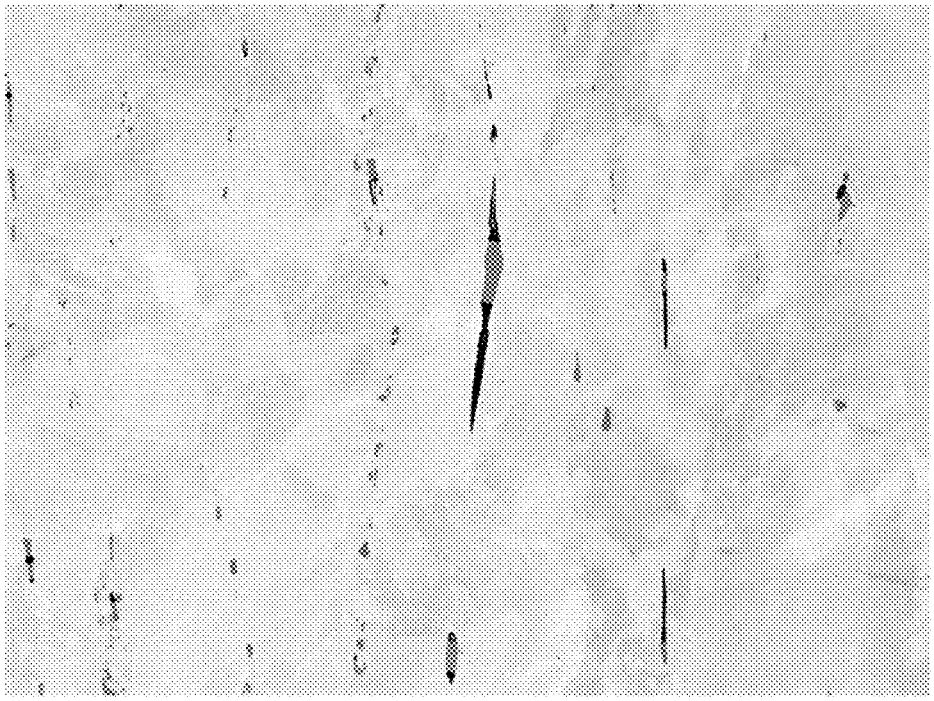
Figure 7D:
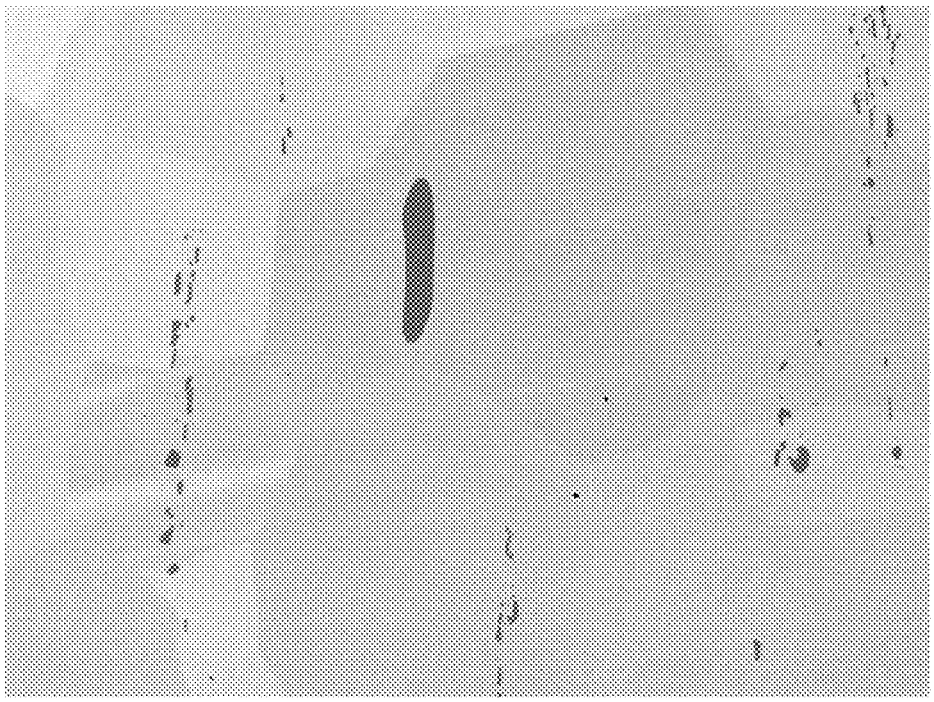

| Sample | Maximum Inclusion Dimension (micrometers) | Maximum Area Fraction (%) | SEM Image Corresponding to Maximum Inclusion Dimension |
|---|---|---|---|
| A1 | 68.7 | 1.66 | FIG. 7A |
| A2 | 48.5 | 1.85 | FIG. 7B |
| B1 | 69.9 | 1.56 | FIG. 7C |
| B2 | 45.2 | 1.59 | FIG. 7D |

The results show that the hot isostatic pressing operations generally decreased the combined sizes and area fractions of the non-metallic inclusions and porosity. A comparison of FIGS. 7A and 7C with FIGS. 7B and 7D, respectively, shows that the hot isostatic pressing operations decreased and in some cases eliminated porosity in the nickel-titanium alloy billets.

Example 5

A nickel-titanium alloy ingot was hot forged, hot rolled, and cold drawn to produce a 0.53-inch diameter bar. The nickel-titanium alloy bar was hot isostatic pressed for 2 hours at 900° C. and 15,000 psi. The hot isostatic pressed bar was sectioned longitudinally to produce five (5) longitudinal sample sections for scanning electron microscopy (SEM). The maximum size and area fraction of contiguous non-metallic inclusions and porosity voids were measured in accordance with ASTM E1245-03 (2008)—*Standard Practice for Determining the Inclusion or Second-Phase Constituent Content of Metals by Automatic Image Analysis*. Each of the five longitudinal cross-sections was inspected using SEM in backscatter electron mode. SEM fields containing the three largest visible regions of contiguous non-metallic inclusions and porosity were imaged at 500× magnification for each sample section. Image analysis software was used to measure the maximum size and the area fraction of the non-metallic inclusions and porosity in each of the three SEM images per sample section. The results are presented in Table 10.

TABLE 10

Figure 8A:
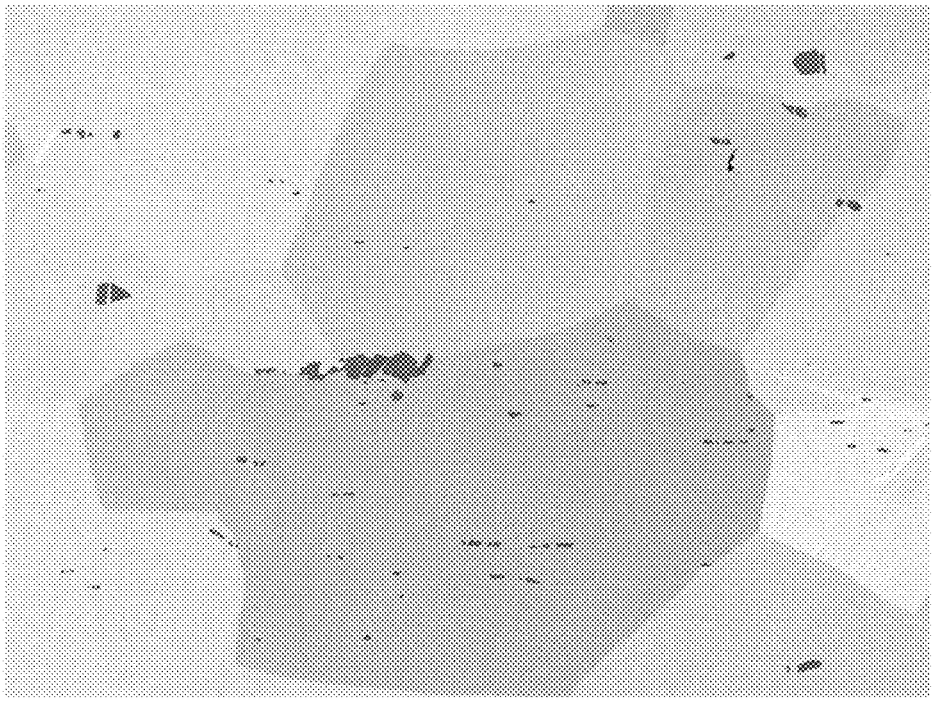
FIGS. 8A-8E are scanning electron microscopy images (500× magnification in backscatter electron mode) of nickel-titanium alloys processed in accordance with embodiments described in this specification.
Figure 8B:
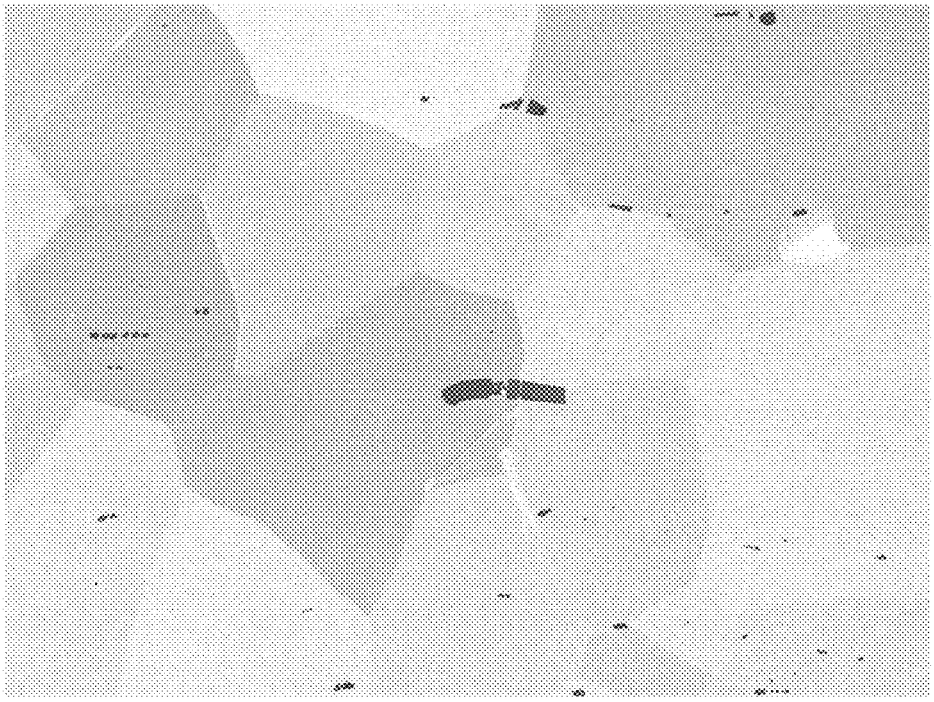
Figure 8C:
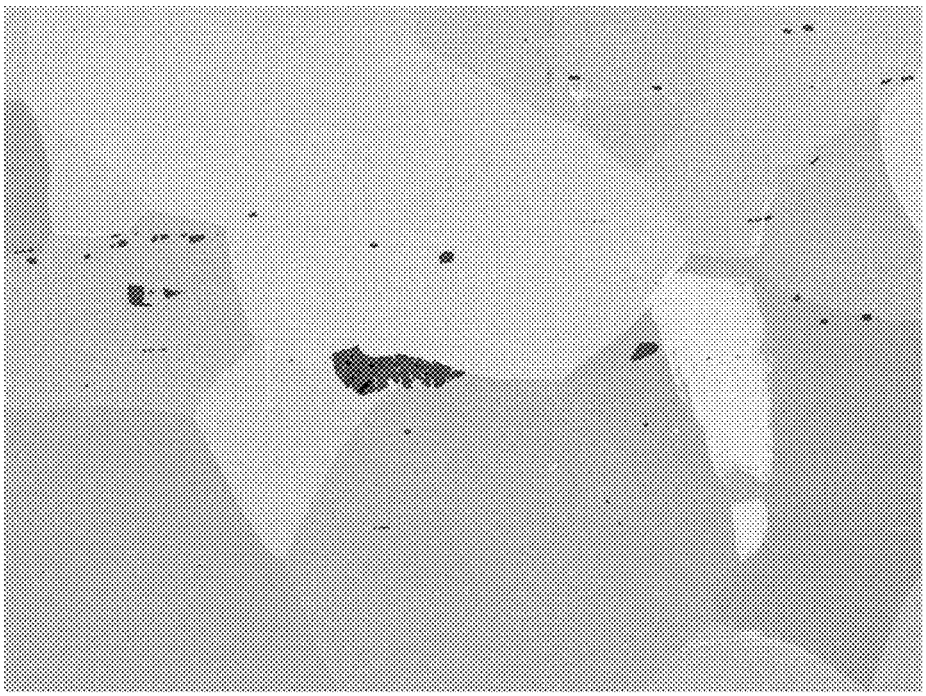
Figure 8D:
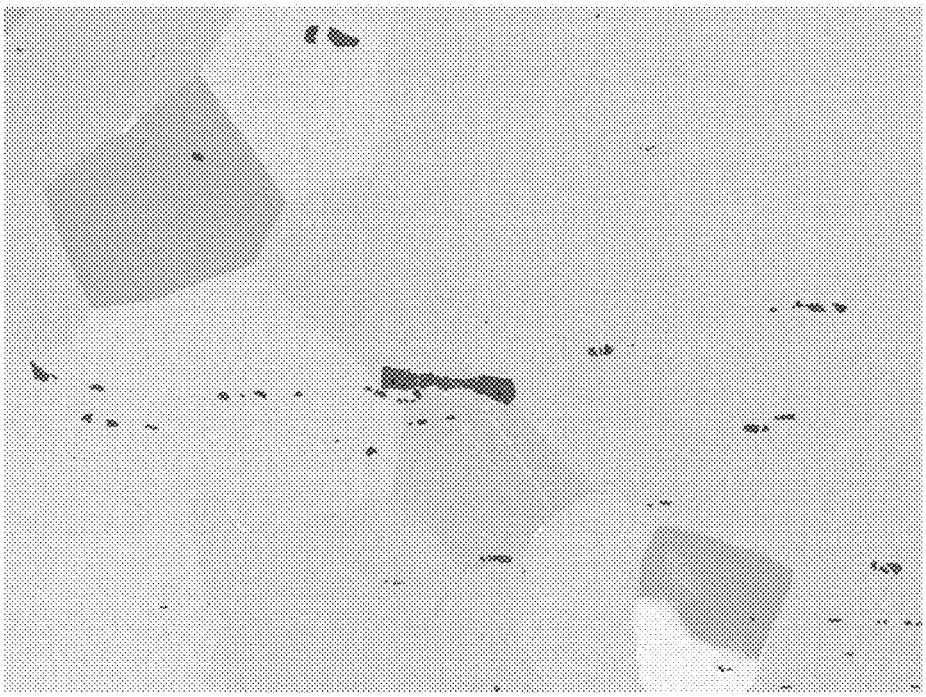
Figure 8E:
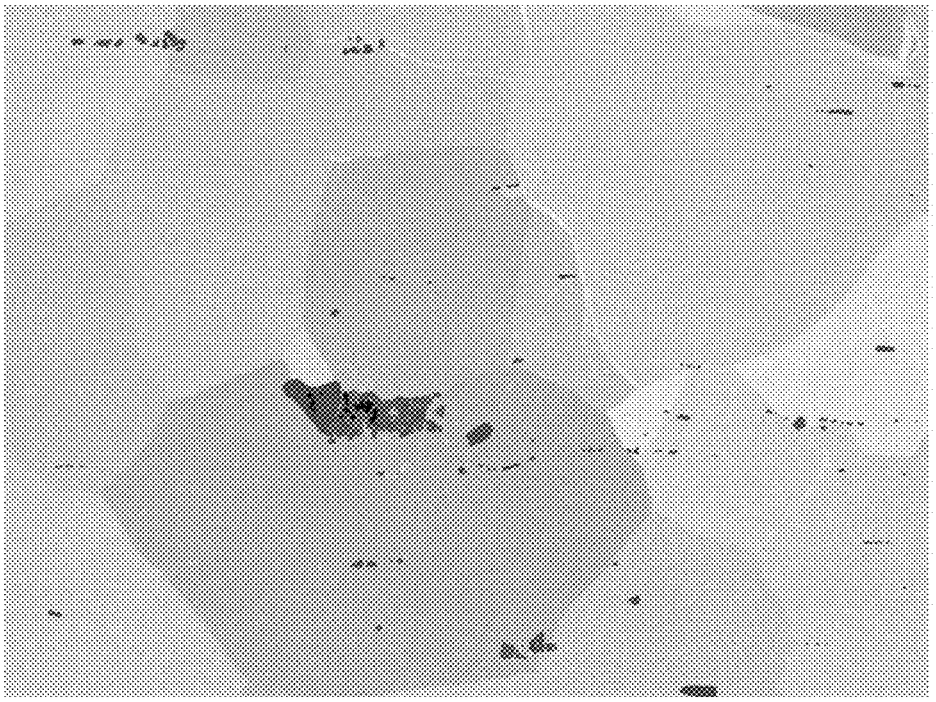

| Sample Section | Maximum Inclusion Dimension (micrometers) | Maximum Area Fraction (%) | SEM Image Corresponding to Maximum Inclusion |
|---|---|---|---|
| 1 | 36.8 | 1.78 | FIG. 8A |
| 2 | 34.3 | 1.36 | FIG. 8B |
| 3 | 37.1 | 1.21 | FIG. 8C |
| 4 | 37.7 | 1.60 | FIG. 8D |
| 5 | 45.0 | 1.69 | FIG. 8E |
| Average | 38.2 | 1.53 | — |

The results show that the cold drawn and hot isostatic pressed nickel-titanium alloy bar generally met the requirements of the ASTM F 2063-12 standard specification (maximum allowable length dimension of 39.0 micrometers (0.0015 inch), and maximum area fraction of 2.8%). A study of FIGS. 6A-6H shows that the hot isostatic pressing operations eliminated porosity in the nickel-titanium alloy bars.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. §§ 112(a) and 132(a).

What is claimed is:

1. A process for the production of a nickel-titanium mill product comprising:

cold working a nickel-titanium alloy workpiece at a temperature less than 500° C.; and hot isostatic pressing the cold worked nickel-titanium alloy workpiece;

wherein the nickel-titanium alloy workpiece comprises at least 35 weight percent titanium and at least 45 weight percent nickel.

2. The process of claim 1, wherein the nickel-titanium alloy workpiece is cold worked at a temperature less than 100° C.

3. The process of claim 1, wherein the nickel-titanium alloy workpiece is cold worked at ambient temperature.

4. The process of claim 1, wherein the cold working comprises at least one cold working technique selected from the group consisting of forging, upsetting, drawing, rolling, extruding, pilgering, rocking, swaging, heading, coining, and combinations of any thereof.

5. The process of claim 1, wherein the cold working comprises cold drawing.

6. The process of claim 1, comprising:

cold working the nickel-titanium alloy workpiece in a first cold working operation at ambient temperature;

annealing the cold worked nickel-titanium alloy workpiece;

cold working the nickel-titanium alloy workpiece in a second cold working operation at ambient temperature; and hot isostatic pressing the twice cold worked nickel-titanium alloy workpiece.

7. The process of claim 6, further comprising, after the second cold working operation and before the hot isostatic pressing, subjecting the nickel-titanium alloy workpiece to:

at least one additional intermediate annealing operation; and at least one additional cold working operation at ambient temperature.

8. The process of claim 6, wherein the nickel-titanium alloy workpiece is annealed at a temperature in the range of 700° C. to 900° C.

9. The process of claim 1, wherein the nickel-titanium alloy workpiece is hot isostatic pressed (HIP) in a HIP furnace operating at a temperature in the range of 700° C. to 1000° C. and a pressure in the range of 3,000 psi to 50,000 psi.

10. The process of claim 1, wherein the nickel-titanium alloy workpiece is hot isostatic pressed (HIP) in a HIP furnace operating at a temperature in the range of 800° C. to 1000° C. and a pressure in the range of 7,500 psi to 20,000 psi.

11. The process of claim 1, wherein the nickel-titanium alloy workpiece is hot isostatic pressed (HIP) in a HIP furnace operating at a temperature in the range of 800° C. to 950° C. and a pressure in the range of 10,000 psi to 17,000 psi.

12. The process of claim 1, wherein the nickel-titanium alloy workpiece is hot isostatic pressed (HIP) in a HIP furnace operating at a temperature in the range of 850° C. to 900° C. and a pressure in the range of 12,000 psi to 15,000 psi.

13. The process of claim 1, wherein the nickel-titanium alloy workpiece is hot isostatic pressed (HIP) for at least 2.0 hours in a HIP furnace operating at a temperature in the range of 800° C. to 1000° C. and a pressure in the range of 7,500 psi to 20,000 psi.

14. The process of claim 1, further comprising hot working the nickel-titanium alloy workpiece at an initial workpiece temperature greater than or equal to 500° C. before the cold working.

15. The process of claim 14, wherein the hot working is performed at an initial workpiece temperature in the range of 600° C. to 900° C.

16. The process of claim 14, wherein the hot working comprises:

hot forging a nickel-titanium alloy ingot at a temperature greater than or equal to 500° C. to produce a nickel-titanium alloy billet; and hot bar rolling the nickel-titanium alloy billet at a temperature greater than or equal to 500° C.

17. The process of claim 16, wherein the hot forging and the hot bar rolling are independently performed at an initial workpiece temperature in the range of 600° C. to 900° C.

18. The process of claim 1, wherein the process produces a mill product selected from the group consisting of a billet, a bar, a rod, a wire, a tube, a slab, a plate, and a sheet.

19. The process of claim 1, wherein:

the cold working reduces size and area fraction of non-metallic inclusions in the nickel-titanium alloy workpiece; and the hot isostatic pressing reduces porosity in the nickel-titanium alloy workpiece.

20. The process of claim 1, wherein the process produces a mill product that meets the size and area fraction requirements of ASTM F 2063-12.

21. A process for the production of a nickel-titanium mill product comprising:

cold working a nickel-titanium alloy in a first cold working operation at ambient temperature;

annealing the cold worked nickel-titanium alloy;

cold working the nickel-titanium alloy in a second cold working operation at ambient temperature; and hot isostatic pressing the twice cold worked nickel-titanium alloy.

22. The process of claim 21, further comprising, after the second cold working operation and before the hot isostatic pressing, subjecting the nickel-titanium alloy to:

at least one additional intermediate annealing operation; and at least one additional cold working operation at ambient temperature.

23. The process of claim 22, wherein the nickel-titanium alloy is annealed at a temperature in the range of 700° C. to 900° C.

24. A process for the production of a nickel-titanium mill product comprising:

hot working a nickel-titanium alloy at an initial workpiece temperature greater than or equal to 500° C.;

subsequent to the hot working, cold working the nickel-titanium alloy at a temperature less than 500° C.; and hot isostatic pressing the cold worked nickel-titanium alloy.

25. The process of claim 24, wherein the hot working is performed at an initial alloy temperature in the range of 600° C. to 900° C.

26. The process of claim 24, wherein the hot working comprises:

hot forging the nickel-titanium alloy at a temperature greater than or equal to 500° C. to produce a nickel-titanium alloy billet; and hot bar rolling the nickel-titanium alloy billet at a temperature greater than or equal to 500° C.

27. The process of claim 26, wherein the hot forging and the hot bar rolling are independently performed at an initial alloy temperature in the range of 600° C. to 900° C.

* * * * *